US006868239B2

(12) United States Patent
Inoue et al.

(10) Patent No.: US 6,868,239 B2
(45) Date of Patent: Mar. 15, 2005

(54) DEVELOPER DETECTION DEVICE AND PRINTER

(75) Inventors: Atsushi Inoue, Nara (JP); Toshio Nishino, Yamatokoriyama (JP); Wataru Yoshida, Hirakata (JP); Fumito Mizoguchi, Nara (JP); Keiji Katoh, Nara (JP); Toshihide Ohgoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 20 days.

(21) Appl. No.: 10/429,709

(22) Filed: May 6, 2003

(65) Prior Publication Data

US 2003/0228160 A1 Dec. 11, 2003

(30) Foreign Application Priority Data

Jun. 7, 2002 (JP) ..... 2002-167368

(51) Int. Cl.[7] ..... G03G 15/08
(52) U.S. Cl. ..... 399/27; 399/102; 399/103
(58) Field of Search ..... 399/27, 61, 64, 399/102, 103, 105, 107, 119

(56) References Cited

U.S. PATENT DOCUMENTS 5,166,731 A * 11/1992 Aimoto et al. ..... 399/103
5,530,530 A * 6/1996 Tanaka et al. ..... 399/64
5,642,186 A * 6/1997 Michlin et al. ..... 399/107
5,923,931 A * 7/1999 Kishimoto ..... 399/102
5,933,678 A * 8/1999 Park ..... 399/27
5,946,530 A * 8/1999 Tsuji et al. ..... 399/103
6,208,816 B1 * 3/2001 Koizumi et al. ..... 399/27
6,295,425 B1 * 9/2001 Garcia et al. ..... 399/103

FOREIGN PATENT DOCUMENTS

JP 5-66600 A 3/1993
JP 5-119529 A 5/1993
JP 11-84850 A 3/1999

* cited by examiner

*Primary Examiner*—William J. Royer
(74) *Attorney, Agent, or Firm*—Birch, Stewart, Kolasch & Birch LLP

(57) ABSTRACT

A detection mechanism is provided with a sealing member made of elastic material for preventing toner leakage between (a) a pierced wall surface of a toner tank through which a rotating shaft is inserted and (b) a second side plate provided on the rotating shaft. With this structure, a flat splicing surface of the sealing member is made to closely contact a second side plate that can be coated with a high lubricant member whose frictional forces is small. When a sealing force of the sealing member is strongly compressed, the sealing member prevents toner from coming into the sliding surface.

29 Claims, 11 Drawing Sheets

DEVELOPER DETECTION DEVICE AND PRINTER

FIELD OF THE INVENTION

The present invention relates to a developer remaining amount detection mechanism, provided in a printer, that detects an amount of developer remaining in a developer tank of a developing device.

BACKGROUND OF THE INVENTION

Conventionally, an electrophotographic system printer (image forming device) such as a copying machine and a printer includes a photosensitive drum (image holding body), a charging section, an exposing section, a developing device, a transcribing section, a fixing section, and the like.

In such a printer, a photosurface of the photosensitive drum is charged and exposed so as to form an electrostatic latent image, and the electrostatic latent image is developed by toner (developer) so as to form a toner image (visualized image). The toner image is transcribed to a sheet (recording medium: printing medium such as a plain paper, an OHP sheet, and the like), so as to be thermally fixed.

Further, it is known that the developing device of the printer includes a developing roller and a toner tank (toner holding tank) for storing toner. The developing device comes to the end of life when the toner runs out, and is replaced with a new one.

However, as to a former printer, maintenance of the developing device (replacement of the developing device) is performed by a specialized service person. Thus, it costs time and money to perform the maintenance, so that a user feels inconvenience.

Recently, a cartridge-type developing device (developing unit) that can be replaced (installed) by the user has been put into practical use, thereby facilitating the maintenance.

As described above, it is necessary to replace the developing device with a new one when the stored toner runs out. Thus, it is general that the developing device includes a toner remaining amount detection mechanism that detects an amount of remaining toner.

A technique relating to such a toner remaining amount detection mechanism is recited in Japanese Unexamined Patent Publication No. 84850/1999 (Tokukaihei 11-84850) (Publication date: Mar. 30, 1999) for example. FIG. 11 illustrates a toner container 200 recited therein.

As shown in FIG. 11, the toner container 200 includes a toner stirring member 201 for carrying toner stored therein to a developing roller. Further, (a) a rotating axis 202 for supporting the toner stirring member 201 and (b) a gear 203 that allows an external force to rotate the toner stirring member 201 are provided on one end side of the toner stirring member 201.

On the other end side of the toner stirring member 201, there is provided a slit plate 205 that passes through a photosensor 204.

The slit plate 205 is a disk having a plurality of slits. The photosensor 204 has a light emitting portion and a light detecting portion so that the slit plate 205 passes therebetween.

Therefore, the light detecting portion of the photosensor 204 is turned ON (receives light from the light emitting portion) when a slit of the slit plate 205 passes through the photosensor 204.

In the toner container 200, rotation of the toner stirring member 201 causes the toner stored therein to be stirred so that a part of the stirred toner is carried to the developing roller.

Further, when the toner stirring member 201 comes into the toner (toner pool) upon stirring the toner, the toner stirring member 201 receives resistance from the toner, so that a rotational speed thereof is reduced for a moment. Thus, a speed at which the slit plate 205 rotating with the toner stirring member 201 passes through the photosensor 204 is reduced, too. As a result, a cycle at which the photosensor 204 detects light (corresponding to a cycle at which the slit passes through the photosensor 204) becomes longer.

On the other hand, when the toner stirring member 201 is out of the toner, the toner stirring member 201 is suddenly released from the resistance of the toner, so that the rotational speed is increased for a moment. Thus, the speed at which the slit plate 205 passes through the photosensor 204 is increased. As a result, the cycle at which the photosensor 204 detects light becomes shorter.

Further, as more toner is stored (more toner remains), a period from (a) a time when the toner stirring member 201 comes into the toner to (b) a time when the toner stirring member 201 gets out of the toner becomes longer.

Thus, in the toner container 200, change of the cycle at which the photosensor 204 detects light is monitored, so that it is possible to estimate the amount of the remaining toner.

The foregoing toner remaining amount detection mechanism is required to rotate the toner stirring member 201 until the developing device including the toner container 200 comes to the end of life, that is, until just before the stored toner runs out. Thus, it is necessary that unwanted rotational resistance to the toner stirring member 201 (unwanted resistance: rotational resistance other than the resistance exerted by the toner stored in the toner tank) is kept at a low level for an extended period of time.

Incidentally, increase in the unwanted resistance to the toner stirring member 201 results from the toner which comes into a gap between the toner stirring member 201 and a roller bearing of the toner container 200.

Then, a ring member (not shown) is provided on the roller bearing of the toner container 200 shown in FIG. 11. The toner stirring member 201 is provided through the ring member, so that the gap is sealed, thereby preventing the toner from coming therein.

However, this configuration brings about such a problem that: when the ring member tightly holds the toner stirring member 201, initial unwanted resistance (resistance exerted by the ring member) to the toner stirring member 201 is increased.

Further, it may be effective that an inner surface (sliding surface) of the ring member is coated with resin which exerts little frictional force to the toner stirring member 201 so as to reduce the resistance exerted by the ring member. However, since the sliding surface is the inner surface of the ring, it is difficult to coat this appropriately, so that a manufacturing cost is increased.

SUMMARY OF THE INVENTION

The present invention was conceived so as to solve the foregoing problems. The present invention provides a developer remaining amount detection mechanism which enables unwanted resistance to a toner stirring member to be kept sufficiently small for an extended period of time.

In order to achieve the foregoing, a remaining amount detection mechanism (detection mechanism) of the present invention includes: a rotating shaft that is inserted into a through hole provided in a developer tank of a developing device used in a printer; a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein: a flange face is provided on an internal portion of the rotating shaft so as to be positioned inside the developer tank, and a sealing member made of elastic material is disposed between (a) pierced wall surface of the developer tank through which the through hole is provided and (b) the flange face provided on the rotating shaft, so as to surround the rotating shaft, and the sealing member closely contacts both the pierced wall surface and the flange face.

The detection mechanism is provided in a developing device (developing unit) used in a printer such as a copying machine, a printer, a facsimile, and the like.

Here, the developing device is to develop an electrostatic latent image using developer such as toner and ink, and includes a developer tank for storing the developer therein. Further, the detection mechanism is to detect an amount (remaining amount) of the developer stored (stocked) in the developer tank.

That is, as described above, in the detection mechanism, the through hole is provided in a side wall of the developer tank, and the rotating shaft is inserted into the through hole. Then, an external portion of the rotating shaft (a portion protruding from the developer tank) is connected to a driving system, and the rotating shaft entirely rotates so that a long axis thereof is used as a rotating central axis.

Further, the stirring member is provided on an internal portion of the rotating shaft (a portion inserted into the developer tank). The stirring member rotates in the developer tank in combination with the rotating shaft, so as to stir the developer stored in the developer tank.

Further, the stirring member receives resistance of the developer while stirring the developer, and varies a rotational condition thereof and a rotational condition of the rotating shaft. Further, strength of the resistance received by the stirring member varies in accordance with an amount (remaining amount) of the developer remaining in the developer tank. Then, in the detection mechanism, the sensor section measures the rotational condition (variation of the rotational condition) of the rotating shaft, so as to detect the amount of the remaining developer.

Specifically, in the detection mechanism, the flange face is provided on the internal portion of the rotating shaft. The flange face is a ring-shaped plane surface so that a rotating central axis of the rotating shaft is regarded as a normal line direction, and is connected to a side face of the rotating shaft so as to surround the rotating shaft with no gap therebetween.

Further, in the detection mechanism, the sealing member made of elastic material is provided between (a) the pierced wall surface of the developer tank (a wall having the through hole into which the rotating shaft is inserted) and (b) the flange face provided on the rotating shaft.

The sealing member prevents the developer from leaking from the through hole of the developer tank, and is provided so that: the sealing member surrounds the rotating shaft and closely contacts both the pierced wall surface and the flange plate.

Further, the sealing member has two contact surfaces (a surface that contacts the pierced wall surface and a surface that contacts the flange face). It is preferable to fix (bond) one surface to the pierced wall surface or the flange face. In this case, the other surface functions as a sliding surface which slides on the pierced wall surface or the flange face.

In this manner, the detection mechanism is arranged so that a plane sliding surface closely contacts the pierced wall surface and the flange face. Thus, in the detection mechanism, it is possible to easily coat the sliding surface with a material whose frictional force is small (with a high lubricant material).

Thus, in the detection mechanism, even when a sealing force of the sealing member is enhanced by making the pierced wall surface and the flange face strongly compress the sealing member so as to prevent the developer from coming into the sliding surface, it is possible to easily suppress the increase of unwanted resistance (rotational resistance other than the resistance exerted by the developer stored in the developer tank) to the rotation of the rotating shaft (and the stirring member). Thus, the detection mechanism is arranged so that it is possible to easily keep the unwanted resistance sufficiently small for an extended period of time.

For a fuller understanding of the nature and advantages of the invention, reference should be made to the ensuing detailed description taken in conjunction with the accompanying drawings.

DESCRIPTION OF THE EMBODIMENTS

One embodiment of the present invention is described as follows.

Figure 2:
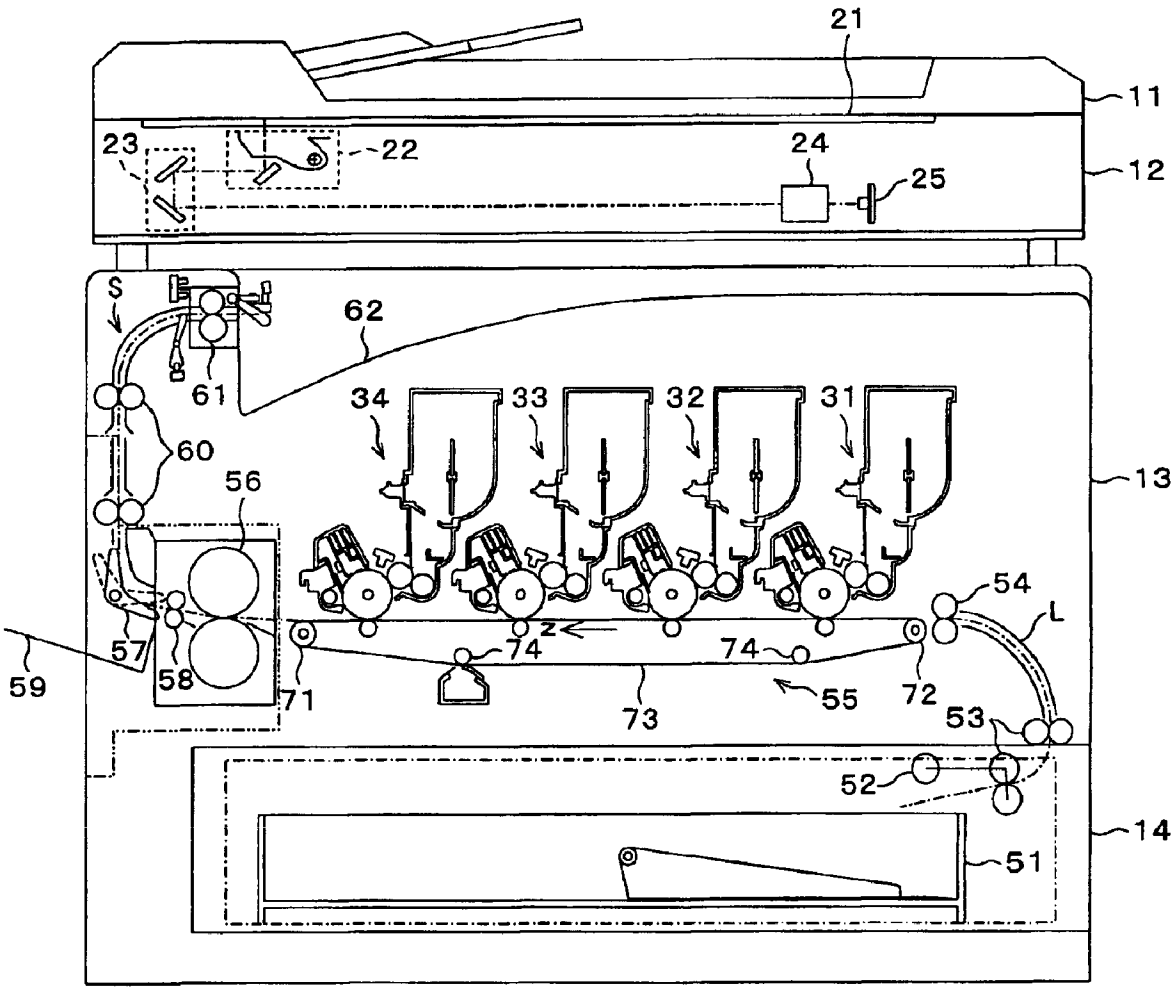
FIG. 2 is an explanatory drawing for illustrating a configuration of the digital color copying machine.

FIG. 2 is an explanatory drawing for showing a front side of a digital color copying machine (present copying machine) according to the present embodiment in terms of a mechanism. The present copying machine has a flapper (front flapper: not shown) on the front side thereof (outward of the plane of the paper). The front flapper is pulled and opened, so that a user (or a service person) can perform a maintenance operation with respect to inside portions thereof.

First, a configuration of the present copying machine is described. As shown in FIG. 2, the present copying machine includes an RADF 11, a scanner section 12, an image forming section 13, and a feeding mechanism 14, and further includes an operation panel (not shown).

The RADF 11 is a document feeder of the present copying machine, and functions as a Recirculating Automatic Document Feeder (RADF).

That is, the RADF 11 transports a document set in a predetermined position to an upper surface of a document table 21 of the scanner section 12. After the scanner section 21 reads a document image, the RADF 11 feeds the document to a predetermined pull-out position.

Further, the RADF 11 reverses the document after the scanner section 12 reads the document image, so as to transport the document to the upper surface of the document table 21 again. Thus, the present copying machine enables the scanner section 12 to read images on both sides of the document.

Moreover, the RADF 11 can be freely opened from the document table 21. Thus, the user closes the RADF 11 upon using the RADF 11, and opens the RADF 11 so as to directly put the document on the document table 21.

The scanner section 12 reads an image of a document transported by the RADF 11, and is an image inputting section of the present copying machine. As shown in FIG. 2, the scanner section 12 includes not only the document table 21, but also a first scanning unit 22, a second scanning unit 23, an optical lens 24, and a CCD 25.

Each of the scanning units 22 and 23 reciprocates in parallel to the document table 21 so as to read the image of the document placed on the document table 21. The first scanning unit 22 includes: an exposing lamp for exposing the document image; and a first mirror for deflecting a reflectional light image, reflected from the document, in a predetermined direction. Further, the first scanning unit 22 reciprocates in parallel to the document table 21 at a predetermined scanning speed so that a constant distance is kept between the first scanning unit 22 and the document table 21.

Further, the second scanning unit 23 includes second and third mirrors each of which deflects the reflectional light image reflected by the first mirror in a direction in which the optical lens 24 is positioned. The second scanning unit 23 reciprocates in parallel to the document table 21 so that a constant speed relationship with the first scanning unit 22 is kept.

The optical lens 24 scales down the reflectional light image from the document that has been deflected by the first to third mirrors, so as to form an image in a predetermined position on a CCD 25.

A CCD 25 is a "Charge Coupled Device" line sensor for photoelectrically transferring the reflectional light image that has been formed as an image so as to generate image information of an electronic signal, and outputs the image information to the image forming section 13.

Moreover, the CCD 25 can read color images. That is, the CCD 25 can generate image information of line data that has been resolved into R (red), G (green), and B (blue).

After the image information generated by the CCD 25 is forwarded to an image processing section (not shown), the image information is processed. Thereafter, the processed image information is outputted to the image forming section 13.

The image forming section 13 prints an image on a sheet (recording medium) in accordance with the image information outputted by the CCD 25. As shown in FIG. 2, the image forming section 13 includes: a black image transcribing section 31; a yellow image transcribing section 32; a magenta image transcribing section 33; and a cyan image transcribing section 34.

These transcribing sections 31 to 34 are arranged in substantially the same manner, and they respectively transcribe a black image, an yellow image, a magenta image, and a cyan image, on a sheet.

Figure 3:
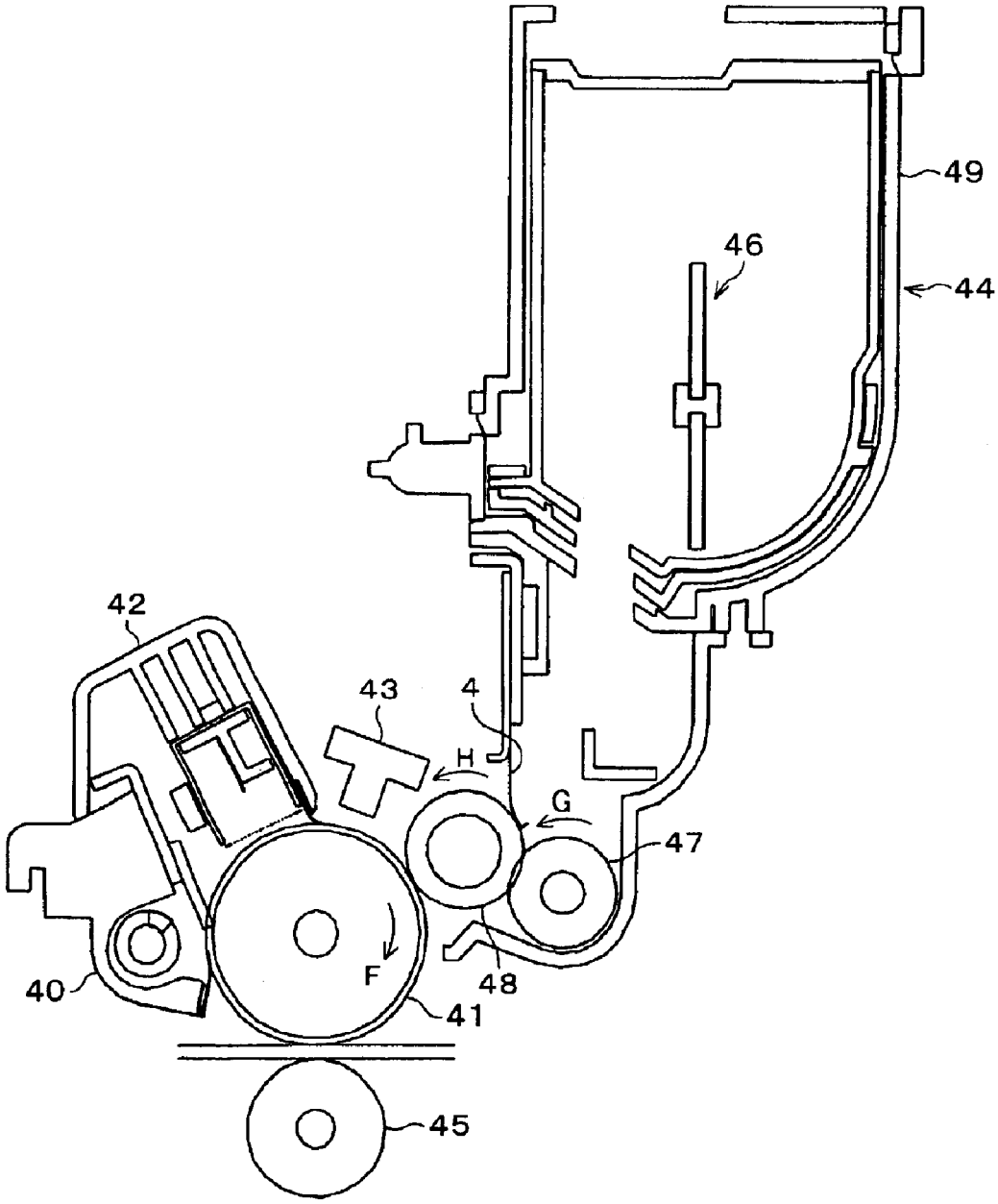
FIG. 3 is an explanatory drawing for illustrating a configuration of a transcribing section provided in the copying machine shown in FIG. 2.

FIG. 3 is an explanatory drawing for illustrating a detail configuration of each of the transcribing sections 31 to 34. As shown in FIG. 3, the transcribing sections 31 to 34 have a photosensitive drum 41, a charging device 42, an LSU 43, a developing unit 44, a discharging device 45 for transcribing, and a cleaning device 40. These devices and units are disposed, along the photosensitive drum 41, in an F direction.

Each photosensitive drum (transcribing drum) 41 is a drum-shaped transcribing roller having photosensitive material thereon, and is driven to rotate in the F direction. The charging device 42 is a scorotron corona discharging device used so that the photosensitive drum 41 is uniformly charged.

The LSUs 43 are exposing devices, and receive pixel signals respectively corresponding to a cyan component, a magenta component, an yellow component, and a black component of the image information.

The LSUs (Laser beam Scanner Unit) 43 of the transcribing sections 31 to 34 receive the pixel signals respectively corresponding to the black component, the yellow component, the magenta component, and the cyan component of the image information. Each LSU 43 exposes the charged photosensitive drum 41 of each of the transcribing sections 31 to 34 in accordance with the image signal so as to generate the electrostatic latent image.

Note that, the LSU 43 includes an LED head (optical line head: not shown). The LED head includes: a substrate having an LED array and a driver for driving the LED array; a SELFOC lens for gathering light of the LED array; and the like. Further, the LED head causes the LED array to emit light in response to the pixel signal, so as to expose the photosensitive drum 41.

Further, the developing units 44 of the transcribing sections 31 to 34 respectively include black toner, yellow toner, magenta toner, and cyan toner. With the toner, the electrostatic latent image generated on the photosensitive drum 41 is developed, so that a toner image is generated.

As shown in FIG. 3, the developing unit 44 includes a toner stirring member 46, a toner supply roller 47, and a developing roller 48 in its toner tank (box body) 49.

The toner stirring member 46 rotates in the developer tank or the toner tank 49 so as to stir the toner, so that the toner is slightly charged. Also, the toner stirring member 46 supplies (drops) the toner to the toner supply roller 47.

Note that, the toner stirring member 46 also detects an amount of toner remaining in the toner tank 49 as a part of the toner remaining amount detection mechanism described later.

The toner supply roller 47 is a rotating roller, provided in the toner tank 49 so as to be opposite to the developing roller 48, that is made of cylinder-shaped foaming rubber elastic material.

A predetermined bias voltage is applied to the toner supply roller 47 so that the toner supply roller 47 can absorb and hold the toner supplied by the toner stirring member 46. With the toner held, the toner supply roller 47 comes into contact with the developing roller 48 while rotating in the same direction (G direction) as the rotating direction of the developing roller 48 (H direction) so that a peripheral speed ratio is 0.5, thereby supplying the toner to a surface of the developing roller 48.

The developing roller 48 is a rotating roller, provided opposite to the photosensitive drum 41. The photosensitive drum is made of cylinder-shaped conductive rubber elastic material. The developing roller 48 comes into contact with the photosensitive drum 41 while rotating in the H direction so that a toner layer formed by the toner supply roller 47 and a toner layer restricting member 4 is held. Thus, the toner is made to adhere to the electrostatic latent image of the photosensitive drum 41, so that the electrostatic latent image is developed, thereby forming the toner image.

Further, the developing unit 44 is a cartridge-type developing device which comes to the end of life and is replaced with a new one when the toner in the toner tank 49 runs out.

Further, upon replacing the developing unit 44, a user (or a service person) opens the front flapper of the present copying machine, and removes an old developing unit 44 by pulling it horizontally to the near side. Thereafter, a new developing unit 44 is slid into the present copying machine so as to be installed.

The discharging device for transcription is a corona discharging roller for transcribing the toner image on the photosensitive drum 41 to a sheet. Note that, power (potential) of the discharging device for transcription is controlled by a power controlling section (not shown). Further, the cleaning device 40 shown in FIG. 3 removes the toner remaining on the photosensitive drum 41 after transcribing the toner image to the sheet.

Further, the feeding mechanism 14 shown in FIG. 2 transports the sheet to a predetermined position so that the image forming section 13 can transcribe the toner image. The feeding mechanism 14 also delivers the sheet to the outside of the present copying machine after transcribing the toner image.

As shown in FIG. 2, the feeding mechanism 14 includes a sheet cassette 51, a pull-out roller 52, a plurality of transport rollers 53 and 60, resist rollers 54, a pre-resist detection switch (not shown), a transcription/transport belt mechanism 55, a fixing device 56, a transport direction switching gate 57, delivery rollers 58 and 61, and delivery trays 59 and 62.

The sheet cassette 51 stores sheets, used in the present copying machine, each of which is in a form of a cut sheet. The pull-out roller 52 is a pick-up roller for delivering the sheets one by one from the sheet cassette 51. The transport rollers 53 carry the sheet delivered from the sheet cassette 51 to a main transport path L, so as to transport the sheet on the main transport path L.

The pre-resist detection switch detects that the sheet transported by the transport rollers 53 pass through a predetermined position on the main transport path L, so as to output a predetermined detection signal.

The resist rollers 54 hold the sheet transported on the main transport path L for a while. Then, the resist rollers 54 cause the transcribing sections 31 to 34 to correspond to each other in terms of timing so that the toner image of each photosensitive drum 41 is preferably transcribed to the sheet, and carries the sheet to the transcription/transport belt mechanism 55.

That is, the resist rollers 54 carry the sheet to the transcription/transport belt mechanism 55 in accordance with the detection signal outputted by the pre-resist detection switch. The sheet is carried so that an edge of the toner image of the photosensitive drum 41 is pushed against an edge of a printing area of the sheet.

As shown in FIG. 2, the transcription/transport belt mechanism 55 includes a driving roller 71, a following roller 72, a transport belt 73, an absorption charging device (not shown), an electricity remover (not shown), and auxiliary rollers 74.

The transport belt 73 is a belt stretched between the driving roller 71 and the following roller 72, and is frictionally driven in a direction Z by the rollers 71 and 72. The sheet sent by the resist rollers 54 is made to adhere to the transport belt 73 in an electrostatic manner, so as to transport the sheet to the transcribing sections 31 to 34 and the fixing device 56.

A charging device for adhesion is a brush provided between the black image transcribing section 31 and the resist rollers 54, and charges a surface of the transport belt 73. That is, in the present copying machine, the transport belt 73 is charged, and the sheet adheres thereto in an electrostatic manner, thereby preventing the sheet from deviating from the path upon transporting the sheet.

The electricity remover is provided between the cyan image transcribing section 34 and the fixing device 56, and causes an AC current to remove electricity from a surface of the transport belt 73.

That is, the toner images of the respective colors are transcribed to the sheet transported by the respective transcribing sections 31 to 34, and the toner images are overlapped with each other. When the cyan image transcribing section 34 finishes transcribing, the electricity removing device removes the sheet from the transport belt 73 in sequence beginning with an edge portion of the sheet, and the sheet is led to the fixing device 56.

The fixing device 56 thermally fixes an unfixed toner image that has been transcribed to the sheet. The sheet that has been subjected to the thermal fixation is transported to the transport direction switching gate 57.

The switching gate 57 selectively switches a transport path of the fixed sheet between (a) a delivery path which leads to the delivery tray 59 provided on a side face of the present copying machine and (b) a sub-transport path S.

The sheet transported to the delivery tray 59 is delivered by the delivery rollers 58 to the delivery tray 59.

Further, the sub-transport path S is the transport path for delivering the sheet to a delivery tray 62 positioned in an upper portion of the image forming section 13. That is, the sheet carried to the sub-transport path S is transported by transport rollers 60 via the sub-transport path S, and is delivered by a delivery rollers 61 to the delivery tray 62.

Next, description is given on the toner remaining amount detection mechanism (present detection mechanism) of the developing unit 44, a characteristic configuration of the present copying machine.

The present detection mechanism detects an amount of the toner remaining in the toner tank 49, and carries out the rotation of the toner stirring member 46 so as to stir the toner.

Figure 1:
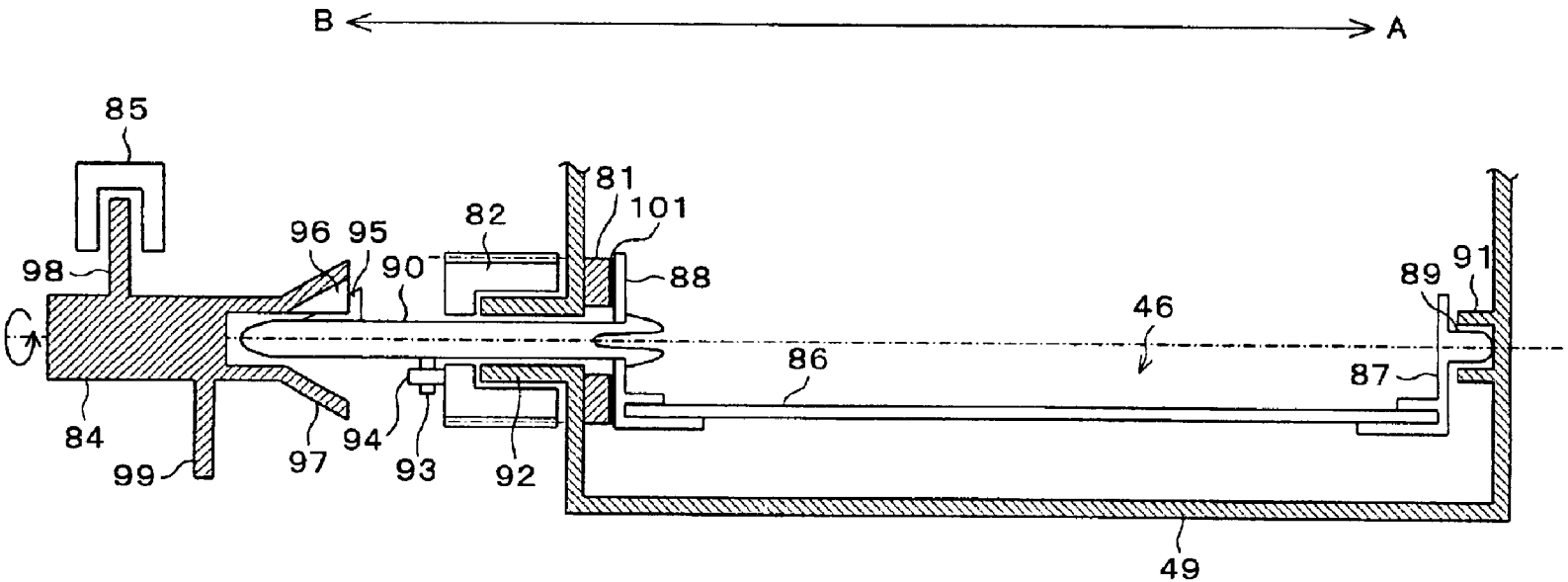
FIG. 1 is an explanatory drawing for illustrating a configuration of a toner remaining amount detection mechanism provided in a digital color copying machine according to the present embodiment.

FIG. 1 is an explanatory drawing for showing a configuration of the present detection mechanism. Note that, FIG. 1 illustrates a view of the present detection mechanism, shown in FIG. 2 and FIG. 3, that is seen from the left side. Thus, a member disposed in a B direction (left side) of FIG. 1 is positioned on the back side (furthest from the front flapper) of the present copying machine. Therefore, members disposed in an A direction are positioned on the side near the front flapper.

As shown in FIG. 1, the present detection mechanism includes not only the toner tank 49 and the toner stirring member 46, but also a sealing member 81, a driving member 82, a rotating body 84, and a photosensor 85.

Note that, the toner tank 49, the toner stirring member 46, the sealing member 81, and the driving member 82 are provided in the developing unit 44. While, the rotating body 84 and the photosensor 85 are provided in a body of the present copying machine.

As described above, the toner stirring member 46 rotates in the toner tank 49 so as to stir the toner, thereby slightly charging the toner. And the toner stirring member 46 also supplies (drops) the toner to the toner supply roller 47 (see FIG. 3).

As shown in FIG. 1, the toner stirring member 46 includes a stirring plate 86, first and second side plates 87 and 88, and first and second rotating shafts 89 and 90.

The stirring plate 86 is a linear plate extending over the substantially whole gamut (in directions A and B) of the toner tank 49, and directly stirs the toner, so as to send part of the toner to the toner supply roller 47.

The first and second side plates 87 and 88 are disk-shaped plates. A side portion of one side plate is connected to the one end portion of the stirring plate 86, and a side portion of the other side plate is connected to the other end portion of the stirring plate 86. Further, flat surfaces of the first and second side plates 87 and 88 extend in a vertical direction with respect to the A-B directions (so that a normal line direction of the flat surface is in the A-B directions). Further, the first and second side plates 87 and 88 respectively have the first and second rotating shafts 89 and 90 in central portions thereof.

The first rotating shaft 89 is a rotational axis which extends from the central portion of the first side plate 87 in the A direction, and has a sphere-shaped head. Further, the first rotating shaft 89 rotates with it covered by an abutting roller bearing 91 provided inside the toner tank 49. While, the second rotating shaft 90 is a rotational axis which extends from the central portion of the second side plate 88 the B direction, and rotates with it covered by a pierced roller bearing 92 provided opposite to the abutting roller bearing 91.

Thus, the toner stirring member 46 rotates around a rotating central axis extending from the first rotating shaft 89 to the second rotating shaft 90 in the A-B directions.

As shown in FIG. 1, the second side plate 88 is a ring-shaped plate whose central portion has a hole into which the second rotating shaft 90 is inserted. Further, a bifurcated hook formed at a head of the second rotating shaft 90 catches the second side plate 88 so that the second rotating shaft 90 is fixed to the second side plate 88.

That is, the second side plate 88 is a flat plate which functions as a flange (flange face) of the second rotating shaft 90 whose normal direction is along a direction in which the second rotating shaft 90 extends (direction of the rotating central axis around which the toner stirring member 46 rotates). The second side plate 88 is connected to a side portion of the second rotating shaft 90 so that the second side plate 88 surrounds the second rotating shaft 90 without any gap therebetween.

Note that, in the toner stirring member 46, the first and second rotating shafts 89 and 90 are positioned in the central portions of the first and second side plates 87 and 88, and the stirring plate 86 is connected to (sandwiched between) end portions of the first and second side plates 87 and 88.

Thus, the stirring plate 86 vertically deviates from the rotating central axis of the toner stirring member 46. Therefore, the toner stirring member 46's center of gravity shifts from the rotating central axis to a position in which the stirring plate 86 exists (the toner stirring member 46 is disproportionately weighted on the side of the stirring plate 86).

Thus, the toner stirring member 46 tends to be positioned so that the stirring plate 86 exists on the lower side. That is, as long as no external force other than gravity exerts and there is no resistance preventing the rotation, the toner stirring member 46 is under such a rotational condition (a condition brought about by the rotation) that: the stirring plate 86 tends to be positioned on the lowest side.

Further, the abutting roller bearing 91 is such that: an end portion of the abutting roller bearing 91 is covered, and a head of the first rotating shaft 89 does not protrude outward. While, the pierced abutting roller bearing 92 is such that: an end portion of the pierced roller bearing is opened, and a head of the second rotating shaft 90 pierces the pierced roller bearing 92.

Note that, there is provided sufficient clearance between a side face of the second rotating shaft 90 and an inside portion of the pierced roller bearing 92 so that they are not in contact with each other.

Further, as shown in FIG. 1, a pin 93 and a side blade 95 are provided on a side face of a protruding part of the second rotating shaft 90 that protrudes from the pierced roller bearing 92 (external portion of the toner tank 49).

Note that, the pin 93 is provided so as to be in contact with a protruding section 94 of the driving member 82 described later. Further, the side blade 95 is a triangle-shaped thin plate which extends along the rotating central axis, and is provided so as to be in contact with a contact blade 96 of the rotating body 84.

The driving member 82 is a ring-shaped member provided so as to surround the pierced roller bearing 92. Further, the driving member 82 is driven by a driving source (not shown) so as to rotate around the pierced roller bearing 92. Further, a protruding section 94 is provided on a side face of the driving member 82 that extends in the B direction.

Further, the driving member 82 rotates with the protruding section 94 being in contact with the pin 93, so that the toner stirring member 46 is entirely rotated via the second rotating shaft 90 having the pin 93.

The rotating body 84 is provided not in the developing unit 44 but on a body of the present copying machine. As shown in FIG. 1, the rotating body 84 has an opening portion 97, a light shielding plate 98, and a balancer 99, and can rotate around an extension of the second rotating shaft 90 (that is, around an extension of the rotating central axis of the toner stirring member 46).

The opening portion 97 has a hole, allowing the head (head in the B direction) of the second rotating shaft 90 to enter therein, whose diameter becomes wider in the A direction (toward an opening end).

Further, the contact blade 96 is provided on an inside wall of the opening portion 97. The contact blade 96 is in contact with the side blade 95 of the second rotating shaft 90, so that the rotating body 84 rotates with the second rotating shaft 90 (that is, the toner stirring member 46).

Thus, in the present copying machine, a driving force received by the driving member 82 causes the driving member 82, the toner stirring member 46, and the rotating body 84 to integrally rotate around the first and second rotating shafts 89 and 90.

Figure 4:
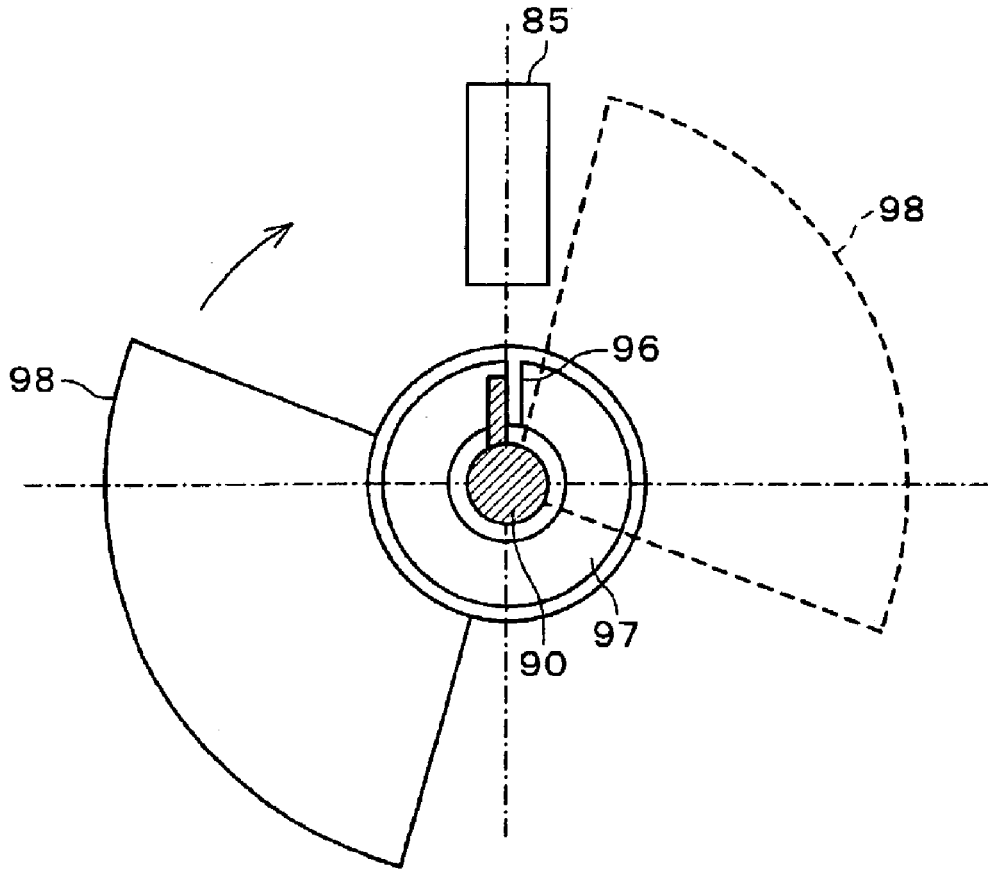
FIG. 4 is an explanatory drawing for illustrating phases of a light shielding plate, provided in the toner remaining amount detection mechanism shown in FIG. 1, that passes through a photosensor.

Further, the light shielding plate 98 of the rotating body 84 is a sector-shaped plate provided on the side face of the rotating body 84 (see FIG. 4). The rotation of the rotating body 84 causes the light shielding plate 98 to pass between a light emitting portion and a light receiving portion of the photosensor 85.

The photosensor 85 is a transmissive photosensor provided in the body of the present copying machine, and has the light emitting portion and the light receiving portion (not shown).

Further, the photosensor 85 outputs a pulse wave of L (Low) when there is no light shielding object between the light emitting portion and the light receiving portion, and outputs a pulse wave of H (High) when there is a light shielding object between the light emitting portion and the light receiving portion.

Thus, the photosensor 85 outputs the H pulse wave when the light shielding plate 98 passes through the photosensor 85.

Further, the present copying machine has a control section (not shown) for receiving the pulse wave from the photosensor 85 so as to process the pulse wave.

The control section lights a notification lamp (not shown) of the present copying machine in case a period in which the H pulse wave is outputted from the photosensor 85 is shorter than a predetermined value, so as to urge a user to replace the developing unit 44.

The balancer 99 is a balance weight for shifting the rotating body 84's center of gravity to the rotating central axis, and is provided on a side face (side face of the rotating body 84) opposite to the light shielding plate 98 with the rotating central axis therebetween.

As long as the rotating body 84 receives no external force (that is, an external force exerted by the side blade 95) for rotating the rotating body 84, the balancer 99 keeps the rotating body 84 as it is under any rotational condition. Thus, the rotating body 84 always rotates in the same manner as in the toner stirring member 46 (the rotating body 84 sometimes rotates slightly due to the force of inertia at a time when the toner stirring member 46 stops).

Here, description is given on a positional relationship between the stirring plate 86 of the toner stirring member 46 and the light shielding plate 98 of the rotating body 84. FIG. 4 is an explanatory drawing for illustrating phases of the light shielding plate 98 which passes through the photosensor 85.

In the present copying machine, when the light shielding plate 98 is in a position shown by a continuous line, the stirring plate 86 is positioned in a top dead center (highest position: unstable equilibrium point) of the rotation of the toner stirring member 46. While, when the light shielding plate 98 is in a position shown by a broken line, that is, right after the light shielding plate 98 has passed through the photosensor 85, the stirring plate 86 is positioned in a bottom dead center (lowest position: stable equilibrium point) of the rotation of the toner stirring member 46.

Next, description is given on a sealing member 81 of the present detection mechanism and members relating thereto. The sealing member 81 shown in FIG. 1 prevents the toner from coming from the toner tank 49 into the pierced roller bearing 92.

The sealing member 81 is a doughnut-shaped member (in a form of a column having an opening in a center thereof) which is made of elastic monofoaming material (foaming material having independent bubbles that are formed separately). Further, the sealing member 81 is disposed between the inside wall of the toner tank 49 and the second side plate 88 with it compressed. That is, one surface of the sealing member 81 is fixed on the inside wall of the toner tank 49 so as to cover an end portion (around an entrance hole) of the pierced roller bearing 92 and a periphery of the second rotating shaft 90. Further, the, other surface of the sealing member 81 is in contact with the second side plate 88 in a flat manner.

Note that, there is sufficient clearance between an inner periphery of the sealing member 81 and the side face of the second rotating shaft 90 so that they are not in contact with each other.

As shown in FIG. 1, a high lubricant member 101 is provided on a contact face of the sealing member 81 that is in contact with the second side plate 88. The high lubricant member 101 is formed by coating the surface of the sealing member 81 with a material whose coefficient of dynamic friction is extremely low (high lubricant material: resin (polyacetal resin, polyolefin resin, nylon resin, fluorine resin, and the like).

Likewise, the second side plate 88 is constituted of the high lubricant material made of polyacetal resin, polyolefin resin, nylon resin, fluorine resin, and the like.

Thus, the resistance caused by the dynamic friction between the sealing member 81 and the second side plate 88 is extremely low.

As described above, the sealing member 81 is compressed between the toner tank 49 and the second side plate 88, so that the sealing member 81 presses (pushes) the second side plate 88 (that is, the toner stirring member 46 entirely) against the inside wall of the toner tank 49 in the A direction.

Further, each of the first side plate 87 and the first rotating shaft 89, that functions as an end portion of the toner stirring member 46 in the A direction, is constituted of a high lubricant material made of polyacetal resin, polyolefin resin, nylon resin, fluorine resin, and the like, and a head of the first rotating shaft 89 (head of the supporting section) is formed in a hemisphere shape.

Thus, the resistance caused by the dynamic friction between the first rotating shaft 89 and the abutting roller bearing 91 is extremely low.

Here, operations of the present detection mechanism are described.

When the present copying machine carries out a printing operation, the toner stirring member 46 stirs the toner in the toner tank 49, so that a driving force (not shown) causes the driving member 82 to rotate around the pierced roller bearing 92.

Thus, the protruding section 94 and the pin 93 are in contact (are engaged) with each other, and the side blade 95 and the contact blade 96 are in contact (are engaged) with each other, so that the driving member 82, the toner stirring member 46, and the rotating body 84 integrally rotate.

This rotation causes the toner stirring member 46 to repeatedly comes into and go out from the stored toner (toner pool) in the toner tank 49, so as to stir the toner.

When the toner stirring member 46 is positioned in the periphery of the top dead center so as not to be in contact with the toner (the toner stirring member 46 is away from the toner pool) upon the rotation, the driving force of the driving member 82 causes the toner stirring member 46 to rotate from the bottom dead center to the top dead center. Further, gravity largely exerts from the top dead center to the bottom dead center, and the toner stirring member 46 is separated from the driving member 82 (that is, the pin 93 is separated from the protruding section 94), thereby rotating downward faster (rotating in a falling manner).

While, when the toner stirring member 46 receives the resistance of the toner stored in the toner tank 49, that is, when the toner stirring member 46 is in contact with the toner (the toner stirring member 46 is in the toner pool), the resistance of the toner largely exerts the toner stirring member 46, so that merely gravity does not enable the toner stirring member 46 to rotate. Thus, at this time, the toner stirring member 46 is rotated by the driving force of the driving member 82.

Therefore, in the present detection mechanism, in case a large amount of the toner remains in the toner tank 49, the toner stirring member 46 reaches the top dead center, then falls into the toner pool and stops rotating before largely rotating in a falling manner. Thereafter, the driving member 82 that has caught up with the toner stirring member 46 causes the toner stirring member 46 to come into the toner pool.

Thus, the light shielding plate 98 of the rotating body 84 rotating with the toner stirring member 46 rotates quickly for a moment at which the toner stirring member 46 rotates in a falling manner, but stops rotating corresponding to the toner stirring member 46 before entering the photosensor 85. Thereafter, a rotational speed thereof is restored to a rotational speed caused by the driving force of the driving member 82. Then, the light shielding plate 98 passes through a whole gamut of the photosensor 85 at this rotational speed.

Figure 5:
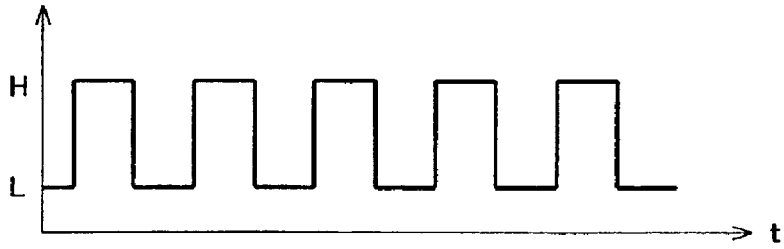
FIGS. 5(*a*) and (*b*) are graphs each of which shows an output pulse wave of a photosensor of the toner remaining amount detection mechanism shown in FIG. 1, and FIG. 5(*a*) shows a pulse wave in case where a large amount of toner remains, and FIG. 5(*b*) shows a pulse wave in case where little toner remains.
Figure 5:
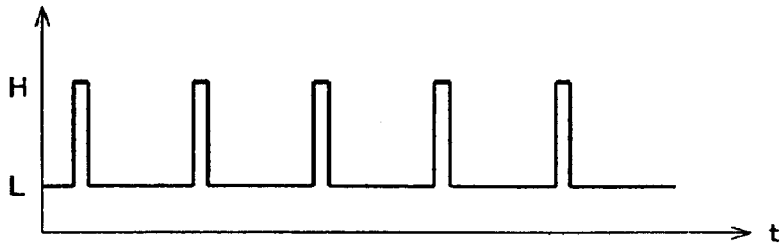

Thus, when a large amount of the toner remains, the photosensor 85 is under such a condition that: a period in which the H pulse wave is outputted is comparatively long as shown in FIG. 5(*a*) (in this figure, the H period is described as being a little longer than an actual H period for comparison with FIG. 5(*b*)).

As the amount of the toner reduces, a distance traveled by the toner stirring member 46 upon rotationally falling from the top dead center becomes longer. Thus, the light shielding plate 98 of the rotating body 84 rotates in a falling manner with the toner stirring member 46 so as to be positioned in the photosensor 85, then stops in the position. The light shielding plate 98 stops in the position until the driving member 82 catches up with the toner stirring member 46. Thereafter, the rotational speed of the light shielding plate 98 is restored to the rotational speed caused by the driving force of the driving member 82. Then, the light shielding plate 98 passes through a whole gamut of the photosensor 85.

Thus, also in this case, the photosensor 85 is under such a condition that the outputted H pulse wave is comparatively long as shown in FIG. 5(*a*).

While, when the toner almost runs out in the toner tank 49, the toner stirring member 46 rotates in a falling manner to a vicinity of the bottom dead center after reaching the top dead center. Thus, the light shielding plate 98 of the rotating body 84 rotates in a falling manner with the toner stirring member 46 so that the light shielding plate 98 entirely passes through the photosensor 85, and stops rotating in the position.

Thus, in this case, the photosensor 85 is under such a condition that: a period in which the H pulse is outputted is extremely short as shown in FIG. 5(*b*).

Receiving a short pulse wave shown in FIG. 5(*b*), the control section lights a notification lamp (not shown) of the present copying machine as described above, so as to urge the user to replace the developing unit 44. Thus, it is possible to detect that there remains little toner in the toner tank 49, so that the user can recognize that it is time to replace the developing unit 44.

As described above, in the present detection mechanism, the second side plate 88 of the second rotating shaft 90 is provided on the internal portion of the second rotating shaft 90. The second side plate 88 is a ring-shaped plate which faces the rotating central axis of the second rotating shaft 90 as a normal line, and is connected to the side face of the second rotating shaft 90 with no gap therebetween so as to surround the second rotating shaft 90.

Further, in the present detection mechanism, the sealing member 81 made of elastic material is provided between (a) a pierced wall surface of the toner tank 49 (a wall having a through hole into which the second rotating shaft 90 is inserted) and (b) the second side plate 88 of the second rotating shaft 90.

The sealing member 81 prevents the toner from leaking from the pierced wall surface, and is provided so as to surround the second rotating shaft 90 and so as to closely contact both the pierced wall surface and the second side plate 88.

Further, the sealing member 81 (one of the contact surfaces of the sealing member 81) is bonded to the pierced wall surface. Between the second side plate 88 and the contact surface (sliding surface), there is provided the high lubricant member 101. Such high lubricant member 101 is formed by coating the sliding surface with a high lubricant material (material whose coefficient of dynamic friction is extremely small; resin and the like).

In this manner, the present detection mechanism is arranged so that the flat sliding surface of the sealing member 81 is provided on the second side plate 88. Thus, in the present detection mechanism, it is possible to easily coat the sliding surface with a material whose frictional force is small (high lubricant material).

Thus, in the present detection mechanism, even when a sealing force of the sealing member 81 is enhanced by making the pierced wall surface and the second side plate 88 strongly compress the sealing member 81 so as to prevent the toner from coming into the sliding surface, it is possible to easily suppress the increase of unwanted resistance (rotational resistance other than the resistance exerted by the toner stored in the toner tank 49) to the rotation of the second rotating shaft 90 (and the stirring plate 86). Thus, the present detection mechanism is arranged so that it is possible to easily keep the unwanted resistance sufficiently small for an extended period of time.

Further, in the present detection mechanism, the second side plate 88 is also made of the high lubricant material. Since the second side plate 88 is a member smaller than the pierced wall surface, it is easy (it costs small) to make the second side plate 88 even with the high lubricant material. Thus, it is possible to further reduce the unwanted resistance at small cost.

Note that, in case the contact surface between the sealing member 81 and the pierced wall surface functions as the sliding surface, it is preferable to apply a ring-shaped thin plate made of high lubricant material to a sliding portion of the pierced wall surface (a portion with which the sliding surface of the sealing member 81 is in contact).

Further, the sealing member 81 is made of monofoaming material which has preferable elasticity and can prevent the toner from infiltrating and permeating. Thus, it is possible to easily improve the sealing force of the sealing member 81.

Further, the present detection mechanism is arranged so that an end portion of the first rotating shaft 89 is supported by the abutting roller bearing 91 provided on a wall opposite to the pierced wall surface in the toner tank 49.

Further, in this configuration, the end portion of the first rotating shaft 89 is formed in a hemisphere shape, and a head thereof has a small cross sectional area. Thus, it is possible to further reduce the unwanted resistance of the rotating shafts 89 and 90.

Further, as the head of the first rotating shaft 89 is pushed by an abutting face (wall) of the abutting roller bearing 90 more strongly, the sealing member 81 is compressed (pressed) more strongly between the second side plate 88 of the second rotating shaft 90 and the inside wall of the toner tank 49. Thus, it is possible to improve the sealing force of the sealing member 81.

Further, the first rotating shaft 89 and the abutting roller bearing 91 are made of the high lubricant material. Thus, it is possible to further reduce the unwanted resistance of the rotating shafts 89 and 90.

Further, the present detection mechanism is arranged so that the developing device is constituted of the developing unit 44, thereby replacing the developing device easily. Moreover, the rotating shafts 89 and 90 and the stirring plate 86 (it is needless to say that also the sealing member 81 is included) of the present detection mechanism are provided in the developing unit 44, and the photosensor 85 and the rotating body 84 that constitute the sensor section are provided in the body of the present copying machine.

Thus, even when the developing unit 44 is replaced with a new one, it is possible to use the same sensor section continuously, so that it is possible to reduce the manufacturing cost of the developing unit 44.

Further, the present detection mechanism includes: the light shielding plate 98 that rotates with the second rotating shaft 90; and the photosensor 85 provided so as to sandwich a rotational orbit of the light shielding plate 98. Thus, it is possible to transcribe a rotational condition of the second rotating shaft 90 based on a rotational condition of the light shielding plate 98. Thus, it is possible to obtain the rotational condition of the second rotating shaft 90 by measuring the rotational condition of the light shielding plate 98.

Further, in this configuration, the light shielding plate 98 passes through the photosensor 85. That is, the light emitting portion and the light receiving portion of the photosensor 85 are disposed so as to sandwich a part of the rotational orbit of the light shielding plate 98 (an area through which the light shielding plate 98 passes), that is, the photosensor 85 is disposed so that the rotating light shielding plate 98 temporarily prevents light, emitted from the light emitting portion, from reaching the light receiving portion.

Thus, the present detection mechanism is arranged so that it is possible to obtain the rotational condition of the light shielding plate 98, that is, the rotational condition of the second rotating shaft 90 by analyzing a light receiving condition of the photosensor 85.

Further, in this configuration, the photosensor 85 and the light shielding plate 98 are provided not in the developing unit 44, but in the present copying machine in advance.

Thus, compared with a configuration in which the light shielding plate 98 is provided in the developing unit 44 and the photosensor 85 is provided in the present copying machine, the foregoing configuration does not bring about such a trouble that the light shielding plate 98 bumps against the photosensor 85 upon installing the developing unit 44. Thus, it is easy to install the developing unit 44.

Further, the present detection mechanism has the balancer 99 so that the rotating body 84's center of gravity is positioned in the rotating central axis. Thus, it is possible to prevent the rotating body 84 from being rotated by its own weight (it is possible to prevent rotation that do not correspond to the rotation of the second rotating shaft 90).

Further, unlike a reflective photosensor, the photosensor 85 is such that: even when a position of the light shielding plate 98 deviates somewhat, a light receiving condition does not vary. Thus, even when an installing position of the developing unit 44 deviates somewhat due to miss handling and the like upon installation, it is possible to exactly measure the rotational condition of the second rotating shaft 90.

Note that, when the reflective photosensor is used, a light reflector is used instead of the light shielding plate 98. In this case, it is preferable to set a distance between the light reflector and the photosensor to a specific value so as to exactly measure a rotational condition brought about by the photosensor.

Further, the developing unit 44 is installed in the present copying machine so as to be inserted along a direction in which a rotating shaft extends (direction of the rotating central axis) so that the pierced wall surface where the second rotating shaft 90 is inserted into the toner tank 49 is disposed on the back side of the present copying machine.

Thus, a portion of the second rotating shaft 90 that protrudes from the toner tank 49 (external portion), the rotating body 84, and the photosensor 85 are disposed, away from the front flapper, in such a position that the user hardly touch them.

Thus, it is possible to prevent the delicate photosensor 85 and the external portion of the second rotating shaft 90 from being damaged by the user who is unfamiliar with the replacement.

Further, the present detection mechanism is arranged so that the developing unit 44 has the driving member 82 for transmitting a rotational force to the second rotating shaft 90. Further, the driving member 82 is provided so as to be in contact with the external portion of the second rotating shaft 90 that is positioned outside the toner tank 49.

Thus, not only the driving member 82 but also driving devices for transmitting a driving force and electric power can be disposed on the back side of the present copying machine. Thus, it is possible to prevent these members from being damaged by the user.

Further, the present detection mechanism is arranged so that the side blade 95, which extends along the rotating central axis of the second rotating shaft 90, is provided on the side face of the second rotating shaft 90. Further, the contact blade 96 and the light shielding plate 98 are provided on the rotating body 84.

Here, the contact blade 96 of the rotating body 84 comes into contact with the side blade 95 of the second rotating shaft 90 from a direction along the rotational direction. Thus, when the second rotating shaft 90 rotates, the side blade 95 of the second rotating shaft 90 and the contact blade 96 of the rotating body 84 are in contact with each other (mesh each other), so that the rotating body 84 and the second rotating shaft 90 integrally rotate.

Further, the light shielding plate 98 of the rotating body 84 passes through the photosensor 85 (passes between the light emitting portion and the light receiving portion) (that is, the photosensor 85 of the sensor section is provided so as to sandwich the rotational orbit of the light shielding plate 98).

Thus, the present detection mechanism is arranged so that it is possible to transcribe the rotational condition of the second rotating shaft 90 as the rotational condition of the light shielding plate 98 provided on the rotating body 84. Thus, it is possible to obtain the rotational condition of the light shielding plate 98 easily by measuring the rotational condition of the second rotating shaft 90.

Further, the present detection mechanism is arranged so that the rotational condition of the second rotating shaft 90 is transcribed as the rotating body 84 by making the side blade 95 of the second rotating shaft 90 and the contact blade 96 of the rotating body 84 mesh (engage) with each other. That is, when the light shielding plate 98 and the second rotating shaft 90 (stirring plate 86) correspondingly rotate, they are identical to each other in terms of the rotational alignment. Thus, it is possible to simplify a corresponding relationship between the rotational condition of the second rotating shaft 90 and the rotational condition of the light shielding plate 98, so that it is easy to measure the rotational condition of the second rotating shaft 90.

Further, the present detection mechanism is arranged so that the rotating body 84 has the cylinder-shaped opening portion 97 through which the second rotating shaft 90 is inserted into the rotating body 84, and the aforementioned contact blade 96 is provided on the inside wall of the opening portion 97. Thus, it is easy to find a disposing position of the second rotating shaft 90 (the second rotating shaft 90 can be disposed by merely being inserted in the opening portion 97) upon installing the developing unit 44, so that it is possible to easily install the developing unit 44. That is, it is possible to cover the positional deviation of the second rotating shaft 90 upon installing the developing unit 44.

Further, the opening portion 97 becomes wider toward an opening end thereof. Thus, it is possible to easily lead the second rotating shaft 90 into the opening portion 97.

Figure 6:
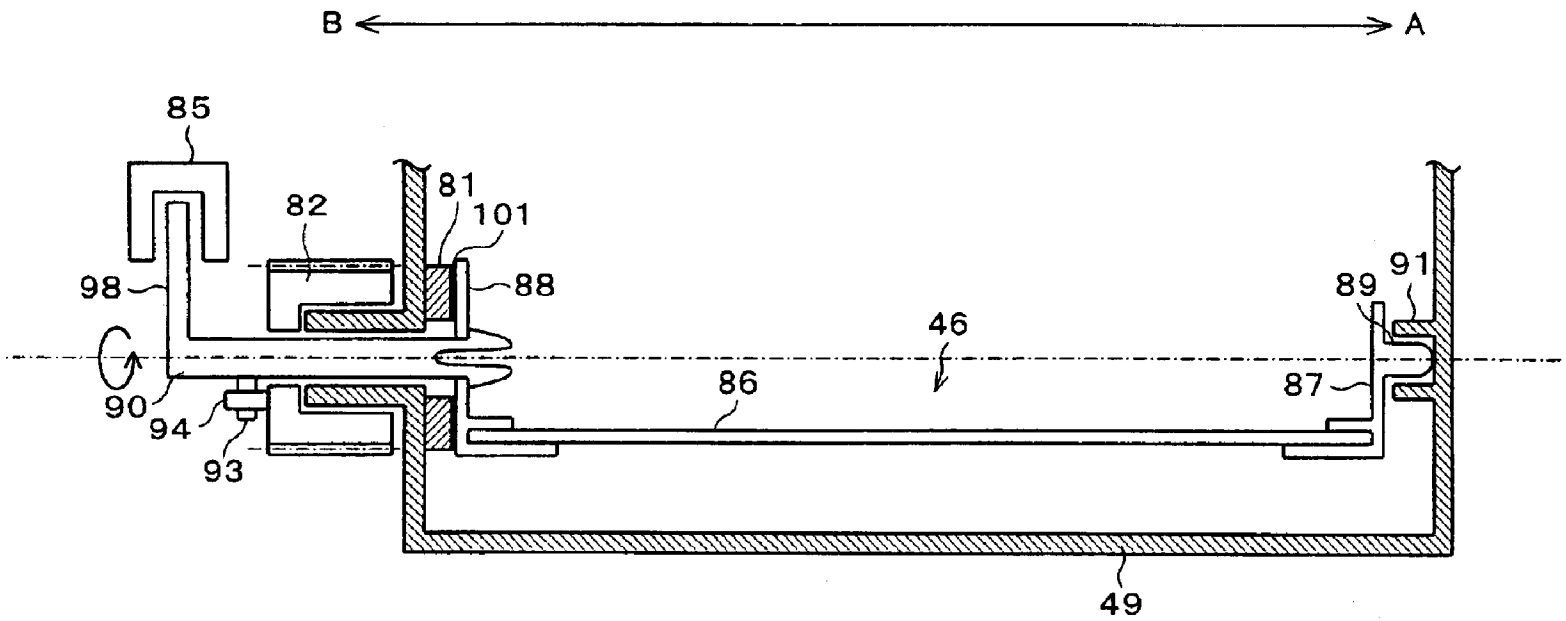
FIG. 6 is an explanatory drawing for illustrating another configuration of the toner remaining amount detection mechanism provided in the digital color copying machine according to the present embodiment.
Figure 7:
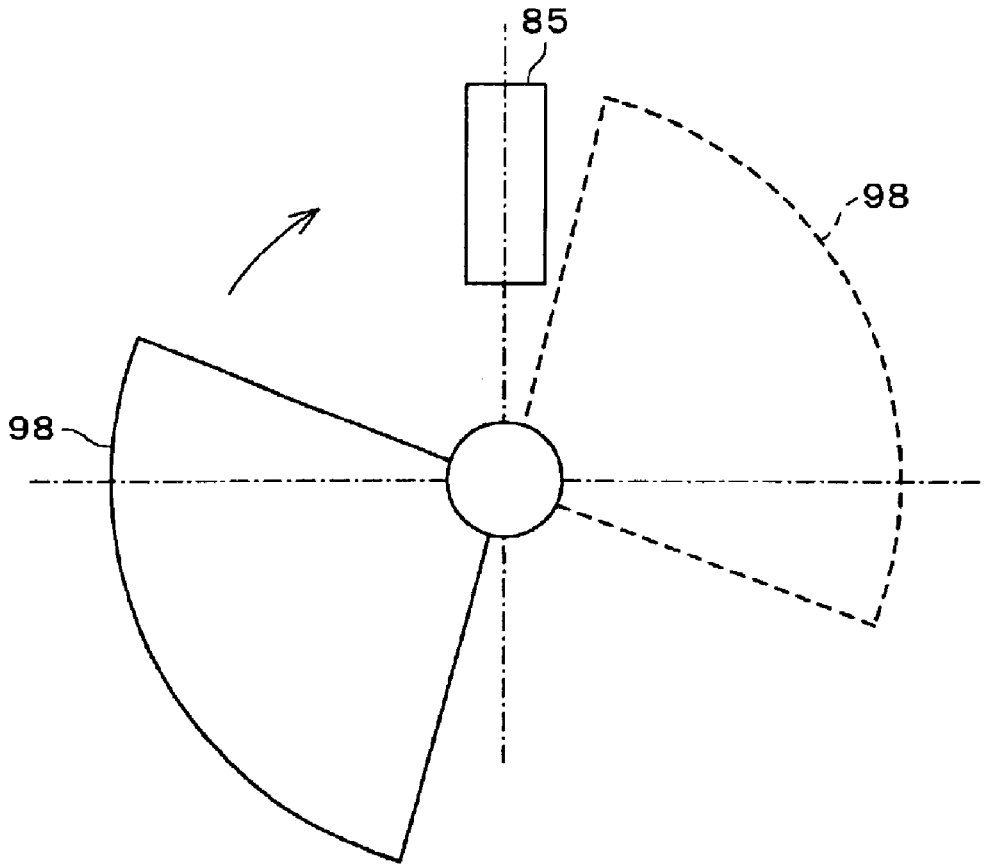
FIG. 7 is an explanatory drawing for illustrating phases of a light shielding plate, provided in the toner remaining amount detection mechanism shown in FIG. 6, that passes through a photosensor.

Note that, in the present embodiment, the present detection mechanism has the rotating body 84 which rotates with the toner stirring member 46. However, the configuration is not limited to this, but the present detection mechanism may be arranged as shown in FIG. 6. Note that, FIG. 7 is an explanatory drawing for illustrating the present detection mechanism in terms of the phase of the light shielding plate 98 which passes through the photosensor 85.

As shown in FIG. 6, the configuration is different from the configuration of the detection mechanism shown in FIG. 1 in that: the rotating body 84 is not provided, and the light shielding plate 98 is provided on a B-direction end portion of the second rotating shaft 90. In this configuration, the function for detecting the amount of the remaining toner is completely the same as the configuration shown in FIG. 1.

Also in this configuration, all the members such as the driving member 82 and the photosensor 85 are disproportionately provided in the B direction, so that the convenience in installing the developing unit 44 is the same as in the configuration shown in FIG. 1 from every view points other than a point concerning the opening portion 97. Further, since the sealing member 81 is used, this configuration is preferable, in terms of the sealing force with respect to the toner, as in the configuration shown in FIG. 1.

In the configuration shown in FIG. 6, it is not necessary to provide the rotating body 84 in the body of the present copying machine, so that it is possible to simplify the configuration, and it is possible to reduce the manufacturing cost.

Note that, in the configuration, it is preferable to adjust the positional relationship between the light shielding plate 98 and the photosensor 85 so that the light shielding plate 98 does not bump against the photosensor 85 upon installing the developing unit 44 in the present detection mechanism.

Further, in this configuration, the photosensor 85 may be provided in the developing unit 44. This configuration prevents the light shielding plate 98 and the photosensor 85 from bumping against each other upon installing the developing unit 44.

Figure 8:
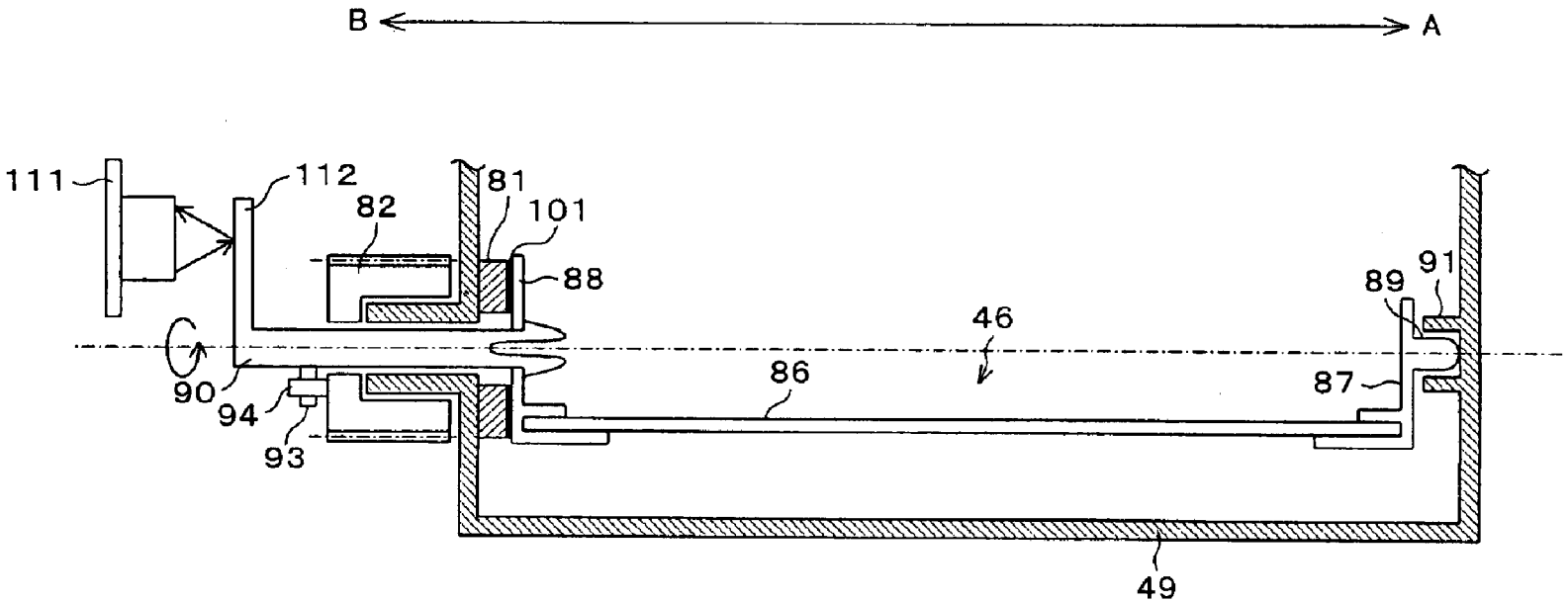
FIG. 8 is an explanatory drawing for illustrating another configuration of the toner remaining amount detection mechanism provided in the copying machine shown in FIG. 2.

Further, in the present embodiment, the present detection mechanism includes a transmissive photosensor as the photosensor 85. However, the configuration is not limited to this, but the present detection mechanism may include a reflective photosensor 111 as the photosensor as shown in FIG. 8.

The detection mechanism is different from the detection mechanism shown in FIG. 6 in that: there is provided the reflective photosensor 111 instead of the photosensor 85, and there is provided a light reflector 112 instead of the light shielding plate 98. The reflective photosensor 111 has a light emitting portion and a light receiving portion as in the photosensor 85. Further, when light emitted from the light emitting portion is reflected by the light reflector 112, the reflected light reaches the light receiving portion. Then, the reflective photosensor 111 is set so that: the H pulse wave is outputted when the light receiving portion receives the light, and the L pulse wave is outputted when the light receiving portion does not receive the light.

This configuration is completely the same as the configuration shown in FIG. 1 in terms of the function for detecting the amount of the remaining toner. Also in this configuration, all the members such as the driving member 82 and the reflective photosensor 111 are disproportionately disposed in the B direction, so that the positional relationship between the reflective photosensor 111 and the light reflector 112 is simple. Thus, in terms of the convenience in installing the developing unit 44, this configuration is superior than the configuration shown in FIG. 1. Further, since the sealing member 81 is used, this configuration is preferable as in the configuration shown in FIG. 1 also in terms of the sealing force with respect to the toner.

If this configuration is used, it is possible to insert the developing unit 44 not only from the B direction but also from an upper direction of the present copying machine (in a vertical direction with respect to the A-B directions), so that the structural limit can be made smaller. Note that, in this configuration, it is preferable to uniform a distance between the reflective photosensor 111 and the light reflector 112 to the utmost, regardless of which type of the developing unit 44 is used.

Figure 9:
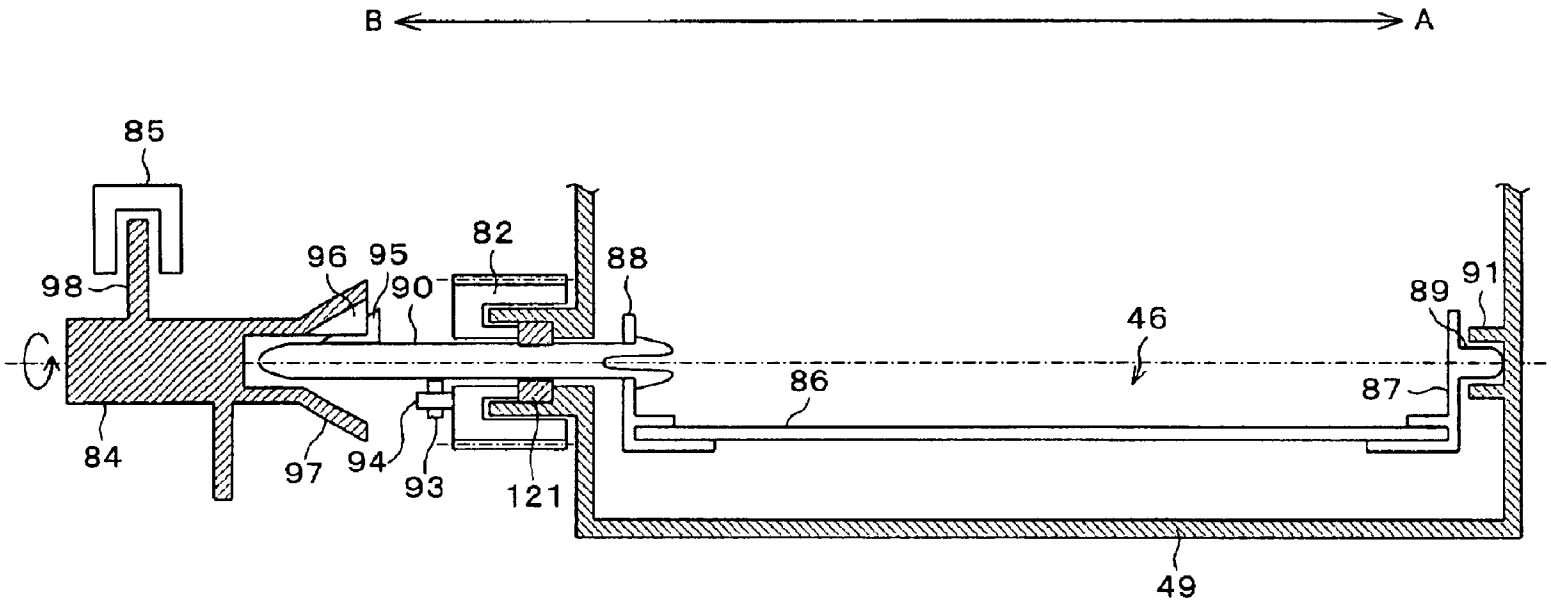
FIG. 9 is an explanatory drawing for illustrating still another configuration of the toner remaining amount detection mechanism provided in the copying machine shown in FIG. 2.

Further, in the present embodiment, the present detection mechanism includes the doughnut-shaped (ring-shaped) sealing member 81 which is disposed so as to be sandwiched between the toner tank 49 and the second side plate 88. However, the present detection mechanism may be arranged as shown in FIG. 9.

The configuration of the detection mechanism is different from the configuration shown in FIG. 1 in that: a sealing ring 121 is provided in a clearance between the second rotating shaft 90 and the pierced roller bearing 92 (shown in FIG. 1) instead of the sealing member 81.

This configuration is completely the same as the configuration shown in FIG. 1. Also in this configuration, the detection mechanism includes the rotating body 84 (opening portion 97), and all the members such as the driving member 82 and the photosensor 85 are disproportionately disposed in the B direction, so that the convenience in installing the developing unit 44 is the same as in the configuration shown in FIG. 1.

Figure 10:
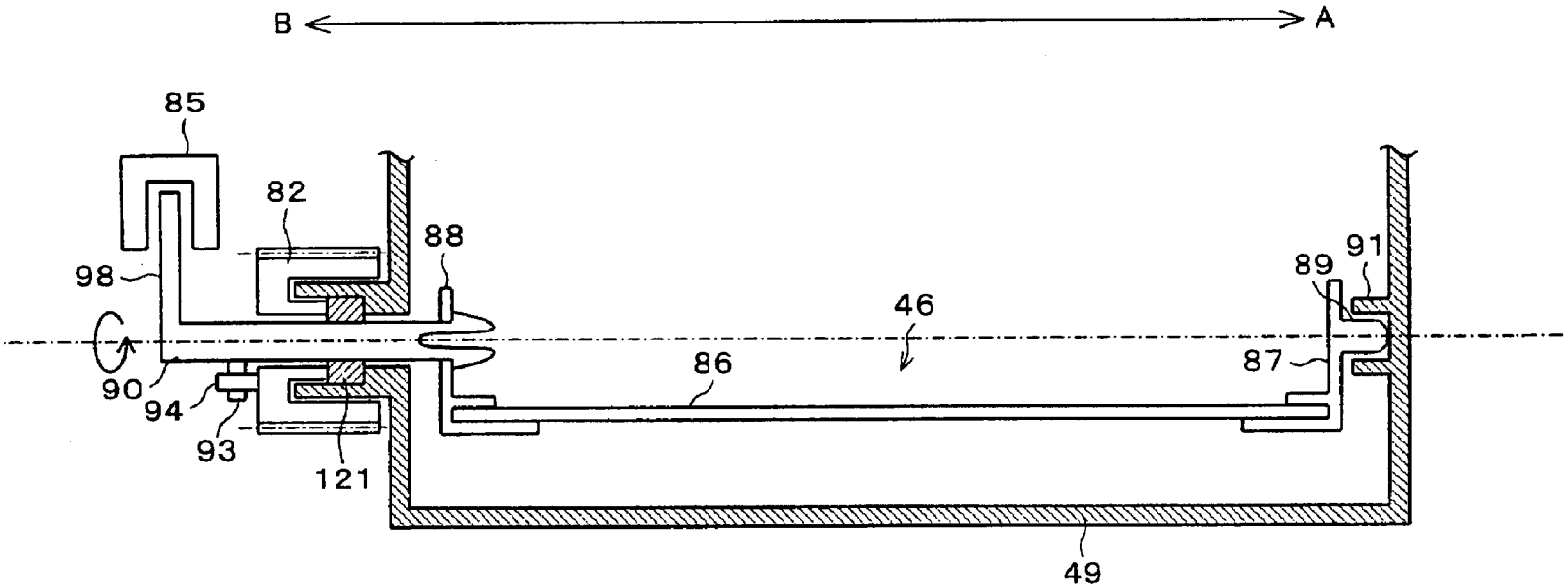
FIG. 10 is an explanatory drawing for illustrating yet another configuration of the toner remaining amount detection mechanism provided in the copying machine shown in FIG. 2.

Further, the present detection mechanism may be arranged as shown in FIG. 10. This configuration is different from the configuration shown in FIG. 9 in that: the rotating body 84 is not provided, and the light shielding plate 98 is provided on the B-direction end portion of the second rotating shaft 90.

Also in this configuration, all the members such as the driving member 82 and the photosensor 85 are disproportionately disposed in the B direction, so that the convenience in mounting the developing unit 44 is the same as in the configuration shown in FIG. 1 from the view points other than a point concerning the opening portion 97.

Note that, in case the sealing ring 121 is used, the toner stirring member 46 is pushed in the A direction, so that it is not necessary to form the head of the first rotating shaft 89 into a spherical shape.

Further, in the present embodiment, the second side plate 88 supporting the stirring plate 86 is made to contact with the sealing member 81. However, the configuration is not limited to this, but the configuration may be such that: another flange face, in addition to the second side plate 88, is provided on the second rotating shaft 90, and the flange face is made to contact with the sealing member 81.

Further, in the present embodiment, the toner stirring member 46 has the two rotating shafts: the first rotating shaft 89 and the second rotating shaft 90. However, the configuration is not limited to this, but it may be so arranged that a single rotating shaft is used. In this case, the shaft extends along the whole area of the toner tank 49 so that the abutting roller bearing 91 supports the head portion of the rotating shaft that is positioned inside the toner tank 49.

Further, the toner used in the present detection mechanism (present copying machine) may be made of one component or two components.

Further, as a material for the high lubricant member applied to each member of the present detection mechanism, it is possible to use high lubricant resin for example. Examples of such resin include: copolymer or homopolymer POM (polyacetal) resin; styrene resin such as high lubricant ABS (acrylic nitro butadiene-styrene) resin and special styrene resin; olefin resin such as high lubricant PP (polypropylene) resin and high lubricant special PE (polyethylene) resin; high lubricant PA (polyamide) resin; PTFE (polytetrafluoro-ethylene).

Further, it is not preferable to use a material that has bad influence on the toner stored in the toner tank 49 (for example, a material that requires lubricant (for example, oil)) as the high lubricant material.

Further, it is preferable to use a material whose frictional coefficient is not more than 0.3 (more preferably, not more than 0.14) as the high lubricant member. This coefficient is measured in case where steel (S45C) is used as a counterpart of the high lubricant member under the following condition: a surface pressure is 0.83 kg/cm$^2$ and a linear velocity is 6.2 cm/sec.

Further, examples of the monofoaming material include: a polyolefine foaming body; a polystyrene foaming body; a polyurethane foaming body; a polyvinyl chloride foaming body; and a fluorine rubber foaming body. Specifically, if the polyurethane foaming body (urethane foam) is used, it is possible to obtain preferable property at small cost.

Further, the developer used in the present detection mechanism (present copying machine) is such that: its average particle diameter is approximately 5 to 15 $\mu$m. As a producing method of such minute particles, it is general to use a crushing method such that: resin, colorant, and the like are kneaded in a fusing manner, then the resultant is crushed and classified. While, a toner producing method called wet grinding method is proposed, and examples thereof include: a suspension polymerization method and an emulsion polymerization method in which monomer having colorant and additive in a dispersing manner are polymerized in aqueous medium under the presence of dispersion stabilizer; and an phase inversion emulsification method recited in Japanese Unexamined Patent Publication No. 66600/1993 (Tokukaihei 5-66600)(Publication date: Mar. 19, 1993), Japanese Unexamined Patent Publication No. 119529/1993 (Tokukaihei 5-119529)(Publication date: May 18, 1993), and the like. Binding resin may be constituted of one kind or more kinds selected from a group of styrene resin such as polystyrene and polystyrene-acrylic ester copolymer, vinyl chloride resin, phenol resin, epoxy resin, polyester resin, polyetherpolyol resin, polyurethane resin, and polyvinyl butyral resin. Further, the aforementioned binding resin may be such that: crystalline waxes or non-compatible substances are minutely dispersed in advance. However, as the aforementioned binding resin, the polyester resin or the polyetherpolyol resin is superior in thermal property such as the resin elasticity, so that it is preferable to use such resin as the binding resin. It is appropriate that a glass transition temperature (Tg) of the resin is within a range of 50 to 90° C. in terms of a heat fusing property and storage stability of the toner.

Further, it is appropriate that a number-average molecular weight (Mn) of the resin is within a range of 3,000 to 100,000. When the number average molecular weight is not more than 3,000, it is difficult to make the resin into particles, and when the number average molecular weight is not less than 100,000, the viscosity is high upon the phase inversion emulsification, thereby having influence on controlling the particle diameter and the particle distribution, so that this is not preferable.

As to the colorant used in the present detection mechanism (present copying machine), a material for the toner is not specifically limited as long as various kinds of pigments or colorants can be used as the material, and it is possible to use the various kinds and various colors of organic or inorganic pigments or colorants. That is, as a black colorant, it is possible to use carbon black, copper oxide, manganese dioxide, aniline black, activated carbon, non-magnetic ferrite, magnetic ferrite, magnetite, and the like.

Further, as an yellow colorant, it is possible to use compounds such as chrome yellow, zinc yellow, cadmium yellow, yellow iron oxide, mineral fast yellow, nickel titanium yellow, navel orange yellow, naphthol yellow S, permanent yellow G, hansa yellow . . . 10G, benzidine yellow G, benzidine yellow GR, quinoline yellow lake, permanent yellow NCG, and tartrazine lake.

Further, as an orange colorant, it is possible to use compounds such as red chrome yellow, molybdate orange, permanent orange GTR, pyrazolone orange, Vulcan orange, Indanthrene Brilliant Orange RK, benzidine orange G, and Indanthrene Brilliant Orange GK.

Further, as a red colorant, it is possible to use compounds such as red iron oxide, cadmium red, red lead, mercury sulfide, cadmium, permanent red 4R, lithol red, pyrazolone red, watching red, calcium salt, lake red C, lake red D, brilliant carmine 6B, eosin lake, rhodamine lake B, alizarin lake, and brilliant carmine 3B. As a purple colorant, it is possible to use compounds such as manganese purple, fast violet B, and methyl violet lake.

Further, as a blue colorant, it is possible to use compounds such as iron blue, cobalt blue, alkali blue lake, victoria blue lake, phthalocyanine blue, nonmetallic phthalocyanine blue, phthalocyanine blue partial chloride, fast sky blue, and Indanthrene Blue BC.

Further, as a green colorant, it is possible to use compounds such as chrome green, chromic oxide, pigment green B, malachite green lake, and final yellow green G. Further, as a white colorant, it is possible to use compounds such as zinc flower, titanium oxide, antimony white, and zinc sulfide. Beside the foregoing materials, components such as magnetic powder, offset inhibitor, and electrification controlling agent can be blended in charged image developing toner of the present detection mechanism (present copying machine).

Further, examples of the magnetic powder include magnetite, hematite, and various kinds of ferrite. As to the offset inhibitor used to improve a fixing property of the toner, a material for the toner is not specifically limited as long as the material can be used to make the toner, and it is possible to use the following materials. For example, it is possible to use (a) petroleum wax such as paraffin wax, paraffin oxide wax, microcrystalline wax, (b) mineral wax such as montanic wax, (c) fauna and flora wax such as bees wax and carnauba wax, and (d) synthesis such as polyolefin wax (polyethylene, polypropylene, and the like), polyolefin oxide wax, and Fischer-Tropsch wax. One kind of the mold lubricant may be used, or two kinds of the mold lubricant may be used.

Further, as the electrification controlling agent, it is possible to use various kinds of material ranging from low molecular weight compound to high molecular weight compound. For example, it is possible to use high molecular weight compound and the like in which quanternary ammonium salt compound, nigrosine compound, organic metal complex, chelate compound, and monomer growing an amino group are homo-polymerized or co-polymerized.

Further, as plasticizer or external additive added to adjust electrification and surface resistance, inorganic powder such as silica fine powder, titanium oxide, and alumina powder is preferably used. The inorganic powder may be processed with processing agent such as silicon varnish, various kinds of modified silicon varnish, silicon oil, various kinds of modified silicon oil, silane coupling agent, silane coupling agent having a functional group, and organic silicon compound. Further, one or more kinds selected from the aforementioned processing agents may be used.

As another additive, lubricant such as polytetrafluoroethylene, zinc stearate, vinyliden polyfluorine, silicon oil particle (containing silicon dioxide of approximately 40%) is preferably used. Further, a small amount of toner particle and a small amount of white particle of antipolarity may be used to improve a developing property.

Further, a preamble of the remaining amount detection mechanism of the present invention can be described as follows: the remaining amount detection mechanism, which detects an amount of developer remaining in a developing device of a printer, includes a stirring member which rotates in the developing device in combination with a rotating shaft while receiving resistance of the developer, wherein the remaining amount detection mechanism detects the amount of the developer remaining in the developing device in accordance with a rotational condition of the stirring member.

Further, in the present embodiment, the second side plate 88 can be described as a flange-shaped cover (flange-face).

As described above, a first remaining amount detection mechanism (first detection mechanism) of the present invention is characterized by including: a rotating shaft that is inserted into a through hole provided in a developer tank of a developing device used in a printer; a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein: a flange face is provided on an internal portion of the rotating shaft so as to be positioned inside the developer tank, and a sealing member made of elastic material is disposed between (a) a pierced wall surface where the through hole is provided in the developer tank and (b) the flange face of the rotating shaft, so as to surround the rotating shaft, and the sealing member closely contacts both the pierced wall surface and the flange face.

The first detection mechanism is provided in a developing device (developing device) used in a printer such as a copying machine, a printer, a facsimile, and the like.

Here, the developing device is to develop an electrostatic latent image using developer such as toner and ink, and includes a developer tank for storing the developer therein. Further, the first detection mechanism is to detect an amount (remaining amount) of the developer stored (stocked) in the developer tank.

That is, as described above, in the first detection mechanism, the through hole is provided in a side wall of the developer tank, and the rotating shaft is inserted in the through hole. Then, an external portion of the rotating shaft (a portion protruding from the developer tank) is connected to a driving system, and the rotating shaft is entirely rotated around a long axis thereof.

Further, the stirring member is provided on an internal portion of the rotating shaft (a portion inserted into the developer tank). The stirring member rotates in the developer tank in combination with the rotating shaft, so as to stir the developer stored in the developer tank.

Further, the stirring member receives resistance of the developer while stirring the developer, and varies a rotational condition thereof and a rotational condition of the rotating shaft. Further, strength of the resistance received by the stirring member varies in accordance with an amount (remaining amount) of the developer remaining in the developer tank. Then, in the first detection mechanism, the sensor section measures the rotational condition (variation of the rotational condition) of the rotating shaft, so as to detect the amount of the remaining developer.

Specifically, in the first detection mechanism, the flange face is provided on the internal portion of the rotating shaft. The flange face is a ring-shaped plane surface faces a rotating central axis of the rotating shaft as a normal line direction, and is connected to a side portion of the rotating shaft so as to surround the rotating shaft with no gap therebetween.

Further, in the first detection mechanism, the sealing member made of elastic material is provided between (a) the pierced wall surface of the developer tank (a wall where the rotating shaft is inserted into the through hole) and (b) the flange face of the rotating shaft.

The sealing member prevents the developer leakage from the through hole of the developer tank, and closely contacts both the pierced wall surface and the flange face so as to surround the rotating shaft.

Further, the sealing member has two contact surfaces (a surface that contacts the pierced wall surface and a surface that contacts the flange face). It is preferable to fix (bond) the one surface to the pierced wall surface or the flange face. In this case, the other surface functions as a sliding surface which slides on the pierced wall surface or the flange face.

In this manner, the first detection mechanism is arranged so that a plane sliding surface closely contacts the pierced wall surface and the flange face. Thus, in the first detection mechanism, it is possible to easily coat the sliding surface with a material whose frictional force is small (high lubricant material).

Thus, in the first detection mechanism, even when a sealing force of the sealing member is enhanced by making the pierced wall surface and the flange face strongly compress the sealing member so as to prevent the developer from coming into the sliding surface, it is possible to easily suppress the increase of unwanted resistance (rotational resistance other than the resistance exerted by the developer stored in the developer tank) to the rotation of the rotating shaft (and the stirring member). Thus, the first detection mechanism is arranged so that it is possible to easily keep the unwanted resistance sufficiently small for an extended period of time.

Further, in the first detection mechanism, it is preferable that the sealing member (the one contact surface of the sealing member) is bonded to either the pierced wall surface or the flange face as described above. Further, it is preferable that the other contact surface (sliding surface) has a high lubricant member. Such high lubricant member can be formed by coating the sliding surface with a high lubricant material (a material whose frictional coefficient is extremely small: resin and the like). Thus, it is possible to make the unwanted resistance extremely small.

Further, as to the sealing member, it is preferable that: one contact surface is bonded to the pierced wall surface, and the other contact surface is made in contact with the flange face of the rotating shaft as the sliding surface. Further, in this case, it is preferable that the high lubricant member is provided on the flange face of the rotating shaft (the flange face is made of high lubricant material, or the flange face is coated with the high lubricant material).

Since the flange face is smaller than the pierced wall surface, it is easy to provide the high lubricant member on the flange face. Thus, it is possible to reduce the unwanted resistance at a small manufacturing cost.

Note that, when the contact surface of the sealing member that contacts the pierced wall surface functions as the sliding surface, it is preferable to apply a ring made of high lubricant material to a sliding portion of the pierced wall surface (a portion that is in contact with the sliding surface of the sealing member).

Further, it is preferable that: the sealing member is made of material, having preferable elasticity, that can prevent infiltration and permeation of the developer, for example, the sealing member is made of monofoaming material. Thus, it is possible to improve the sealing force of the sealing member.

Further, in the first detection mechanism, it is preferable that: one end portion of the rotating shaft that is inserted into the developer tank (an end portion on the side of the internal portion) is supported by the roller bearing provided on a wall opposite to the pierced wall surface in the developer tank. Thus, it is possible to easily stabilize the rotation of the rotating shaft.

Further, in this configuration, it is preferable that: a head of the end portion of the rotating shaft has a cross sectional area smaller that that of the rotating shaft. Thus, it is possible to further reduce the unwanted resistance of the rotating shaft.

Further, it is preferable that: as more strongly the head of the rotating shaft is pushed against an abutting surface (wall) of the roller bearing, more strongly the sealing member is compressed (pressed) between the flange face of the shaft and the inside wall of the developer tank. Thus, it is possible to improve the sealing force of the sealing member.

Note that, it may be so arranged that: the internal portion of the rotating shaft is formed in a diminution manner so that the cross sectional area becomes smaller toward the head of the rotating shaft.

Further, it is preferable that: the end portion of the internal portion of the rotating shaft and the abutting surface are made of high lubricant material. Thus, it is possible to further reduce the unwanted resistance.

Further, it may be so arranged that: a single rotating shaft is provided, or two rotating shafts are provided on both end portions of the stirring member. When two rotating shafts are provided, the end portion of the internal portion functions as a head of a shaft provided separately from a shaft having the external portion protruding from the developer tank.

Further, the developing device including the developer tank can be also constituted of a developing unit detachable from a body of the printer so as to facilitate replacement of the developing device.

In this case, it is preferable that: the rotating shaft and the stirring member (needless to say, also the sealing member) of the first detection mechanism are included, and the sensor section is provided in the body of the printer. Thus, even when the developing unit is replaced, it is possible to continuously use the same sensor section, thereby reducing maintenance cost of the developing unit.

Further, in this case, it is preferable that: the sensor section includes: a light shielding plate which rotates with the rotating shaft; and a transmissive photosensor provided so as to sandwich a rotational orbit of the light shielding plate.

With this configuration, the sensor section can transcribe a rotational condition of the rotating shaft as a rotational condition of the light shielding plate. Thus, it is possible to obtain the rotational condition of the rotating shaft by measuring the rotational condition of the light shielding plate.

Further, in this configuration, it is preferable that: the light shielding plate passes through the transmissive photosensor.

Here, the transmissive photosensor includes a light emitting portion for emitting light and a light receiving portion for receiving the light. In this configuration, the light emitting portion and the light receiving portion of the transmissive photosensor are disposed so as to sandwich a part of the rotational orbit of the light shielding plate (an area through which the light shielding plate passes), that is, so as to temporarily prevent the light emitted by the light emitting portion from reaching the light receiving portion by means of the rotating light shielding plate.

Thus, the sensor section can obtain the rotational condition of the light shielding plate, that is, the rotational condition of the rotating shaft, by analyzing a light receiving condition of the light receiving portion of the transmissive photosensor.

Further, in this configuration, the transmissive photosensor and the light shielding plate are provided not in the developing unit, but in the body of the printer in advance.

Thus, compared with the configuration where the light shielding plate is provided in the developing unit and the transmissive photosensor is provided in the body of the printer, this configuration does not bring about such a problem that the light shielding plate and the photosensor bump against each other. Thus, it is possible to easily install the developing unit.

Unlike the reflective photosensor, in the transmissive photosensor, the light receiving condition does not vary even when a position of the light shielding plate deviates somewhat. Thus, even when an installing position of the developing unit deviates somewhat due to individual difference of the developing unit, miss handling, and the like, upon installation, it is possible to exactly measure the rotational condition of the second rotating shaft.

Note that, when the reflective photosensor is used, there is provided a light reflector instead of the light shielding plate. In this case, it is preferable to set a distance between the light reflector and the photosensor to a specific value so that the photosensor exactly measures the rotational condition.

Further, it is preferable that: the developing unit is installed, along a direction in which the rotating shaft extends (direction of the rotating central axis), to the printer so that the pierced wall surface where the rotating shaft is inserted into the developer tank is disposed on the back side of the printer.

Here, the back side of the printer means a downstream side of a direction in which the developing unit is installed. That is, generally, the flapper of the printer is opened, and the developing unit is slid into a predetermined position upon installing the developing unit. Then, the back side of the printer is a side internally far from the flapper of the printer (downstream side of a direction in which the developing unit is slid).

In this configuration, the protruding portion of the rotating shaft that is positioned outside the developer tank (external portion), the sensor section provided in the printer, and the like are disposed away from the flapper of the printer so that the user hardly reaches these members. Thus, it is possible to prevent the delicate sensor section and the external portion of the rotating shaft from being damaged by the user who is unfamiliar with the replacement.

Further, in this configuration, it is preferable that the developing unit includes a driving member for transmitting a rotational force to the rotating shaft. Further, it is preferable that the driving member is provided so as to be in contact with the external portion of the rotating shaft that is positioned outside the developer tank.

Thus, not only the driving member but also a driving system for transmitting a driving force and power can be disposed on the back side of the printer. Thus, it is possible to prevent these members from being damaged by the user.

Further, a second remaining amount detection mechanism (second detection mechanism) of the present invention is characterized by including: a rotating shaft that is inserted into a through hole provided in a developer tank of a developing device used in a printer; a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein: the rotating shaft and the stirring member are provided in a developing unit, including the developer tank, that is detachable from a body of the printer, and the sensor section is provided in the body of the printer, and the rotating shaft has a side blade, which extends along a rotating central axis, on a side face thereof, and the sensor section has (i) a rotating body for rotating around the rotating central axis of the rotating shaft and (ii) a transmissive photosensor, and the rotating body has (a) a contact blade which contacts the side blade of the rotating shaft from a direction along a rotational direction and (b) a light shielding plate for passing through the transmissive photosensor of the sensor section.

As in the first detection mechanism, the second detection mechanism is provided in the developing device used in the printer, and detects the amount (remaining amount) of the developer stored in the developer tank in accordance with the rotational condition of the rotating shaft.

Further, in the second detection mechanism, the developing device having the developer tank is constituted of the aforementioned developing unit. Further, the developing unit includes the rotating shaft and the stirring member, and the sensor section is provided in the body of the printer. Thus, even when the developing unit is replaced, it is possible to continuously use the same sensor section.

Further, in the second detection mechanism, the side blade extending along the rotating central axis is provided on the side face of the rotating shaft.

Moreover, the sensor section has (a) the rotating body that rotates around the rotating central axis of the rotating shaft and (b) the transmissive photosensor. Further, the rotating body has the contact blade and the light shielding plate.

Here, the light shielding plate of the rotating body comes into contact with the side blade of the rotating shaft from the direction along the rotational direction. Thus, when the rotating shaft rotates, the side blade of the rotating shaft and the contact blade of the rotating body are in contact (mesh) with each other, so that the rotating body and the rotating shaft integrally rotate.

Further, as in the light shielding plate of the first detection mechanism, the light shielding plate of the rotating body passes through the transmissive photosensor (between the light emitting portion and the light receiving portion) of the sensor section (that is, the transmissive photosensor of the sensor section is provided so as to sandwich the rotational orbit of the light shielding plate).

Thus, in the second detection mechanism, the sensor section can transcribe the rotational condition of the rotating shaft as the rotational condition of the light shielding plate provided on the rotating body. Thus, it is possible to obtain the rotational condition of the rotating shaft by measuring the rotational condition of the light shielding plate.

Further, in the second detection mechanism, the side blade of the rotating shaft and the contact blade of the rotating body are made to mesh (engage) with each other, so that the rotational condition of the rotating shaft is transcribed as that of the rotating body. That is, when they rotate together, the rotational phase of the light shielding plate and the rotational phase of the rotating shaft (stirring member) are under the same condition. Thus, it is possible to simplify the relationship between the rotational condition of the rotating shaft and the rotational condition of the light shielding plate, thereby facilitating measurement of the rotational condition of the rotating shaft.

Further, in the second detection mechanism, the transmissive photosensor and the light shielding plate are provided not in the developing unit, but in the body of the printer in advance. Thus, this configuration cannot bring about such a problem that: the light shielding plate and the photosensor bump against each other upon installing the developing unit. Therefore, it is possible to easily install the developing unit.

Note that, it is preferable to provide a balancer so as to shift the rotating body's center of gravity to the rotating central axis. Thus, it is possible to prevent the rotating body from being rotated by its own weight (it is possible to prevent rotation that do not correspond to the rotation of the rotating shaft).

Further, also in the second detection mechanism, it is preferable that: the developing unit is installed, along a direction in which the rotating shaft extends (direction of the rotating central axis), in the printer so that the pierced wall surface where the rotating shaft is inserted into the developer tank is disposed on the back side of the printer.

In this configuration, the protruding portion of the rotating shaft that is positioned outside the developer tank (external portion), the sensor section provided in the printer, and the like are disposed away from the flapper of the printer so that the user hardly reaches these members. Thus, it is possible to prevent the delicate sensor section and the external portion of the rotating shaft from being damaged by the user who is unfamiliar with the replacement.

Further, also in the second detection mechanism, it is preferable that the developing unit includes a driving member for transmitting a rotational force to the rotating shaft. Further, it is preferable that the driving member is provided so as to be in contact with the external portion of the rotating shaft that is positioned outside the developer tank.

Thus, not only the driving member but also a driving system for transmitting a driving force and power can be disposed on the back side of the printer. Thus, it is possible to prevent these members from being damaged by the user.

Further, in the second detection mechanism, it is preferable that: the rotating body has a cylinder-shaped opening portion through which the rotating shaft is inserted into the rotating body of the sensor section, and the aforementioned contact blade is provided on an inside wall of the opening portion. Thus, it is easy to find a disposing position of the second rotating shaft (by merely inserting the rotating shaft into the opening portion) upon installing the developing unit, so that it is possible to easily install the developing unit.

Further, it is preferable that an opening end of the opening portion is extended so as to facilitate insertion of the rotating shaft.

Further, a third remaining amount detection mechanism (third detection mechanism) of the present invention is characterized by including: a rotating shaft that is inserted into a through hole provided in a developer tank of a developing device used in a printer; a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein: the rotating shaft and the stirring member are provided in a developing unit, including the developer tank, that is detachable from a body of the printer, and the developing unit includes a driving member for transmitting a rotational force to the rotating shaft, and the driving member is in contact with an external portion of the rotating shaft so as to be positioned outside the developer tank, and the developing unit is installed along the rotating shaft into the printer so that the pierced wall surface where the rotating shaft is inserted into the developer tank is disposed on a back side of the printer.

As in the first and second detection mechanisms, the third detection mechanism is provided in the developing device used in the printer, and detects the amount (remaining amount) of the developer stored in the developer tank in accordance with the rotational condition of the rotating shaft.

Further, in the third detection mechanism, the developing device having the developer tank is constituted of the aforementioned developing unit as in the second detection mechanism. Further, the developing unit includes the rotating shaft and the stirring member.

Further, also in the third detection mechanism, it is preferable that the sensor section is provided in the body of the printer. Thus, even when the developing unit is replaced, it is possible to continuously use the same sensor section.

Further, in the third detection mechanism, the developing unit is installed along the rotating shaft in the printer so that the pierced wall surface where the rotating shaft is inserted into the developer tank is disposed on the back side of the printer.

In this configuration, the protruding portion of the rotating shaft that is positioned outside the developer tank (external portion), the sensor section provided in the printer, and the like are disposed away from the flapper of the printer so that the user hardly reaches these members. Thus, it is possible to prevent the delicate sensor section and the external portion of the rotating shaft from being damaged by the user who is unfamiliar with the replacement.

Further, in the third detection mechanism, it is preferable that the developing unit includes a driving member for transmitting a rotational force to the rotating shaft. Further, it is preferable that the driving member is provided so as to be in contact with the external portion of the rotating shaft that is positioned outside the developer tank.

Thus, not only the driving member but also a driving system for transmitting a driving force and power can be disposed on the back side of the printer. Thus, it is possible to prevent these members from being damaged by the user.

Further, the printer of the present invention includes any one of the aforementioned first to third remaining amount detection mechanisms. Thus, it is possible to realize a printer that controls the unwanted resistance caused by the toner leakage, and easily measures the rotational condition of the rotating shaft, and prevents the remaining amount detection mechanism from being damaged by the user.

Further, it can be said that: the present invention relates to a developing device of an electrophotographic image forming device such as a copying machine, a printer, and the like, which forms an image on a recording medium by using an electrophotographic technique. In more detail, it can be said that: the present invention relates to a developer remaining amount detection mechanism which detects an amount of developer stored in a developer tank.

Further, the image forming device such as the printer or the copying machine selectively exposes an image holding body that has been uniformly charged by a charging section so as to form a latent image, and causes the developing device to visualize the latent image with the developer, and transcribes the image formed with the developer to the recording medium so as to record the image. In such a device, maintenance of the developing device is performed by a specialized service person, so that the user feels bothered. Then, a cartridge type developing device is used so that the user installs the developing device in the image forming device. Thus, it is possible to replace a developing device which has come to the end of life due to consumption of the developer, thereby facilitating the maintenance. Such developing device is in practical use. It is necessary to replace the developing device with a new one when the developer stored in advance runs out. Generally, the developing device includes a developer remaining amount detection mechanism which detects that little developer remains in the developing device.

Further, it can be said that a conventional device brings about the following problems. That is, the developer remaining amount detection mechanism is required to allow a developer remaining amount detection member (toner stirring member) to smoothly free-falls due to gravity until the developing device comes to the end of life, that is, just before the developer stored in the developing device runs out. That is, rotational resistance other than the rotational resistance exerted on the developer remaining amount detection member by the developer needs to be kept sufficiently small at an initial state and with the lapse of time. The sliding resistance between the developer remaining amount detection mechanism and the sliding member needs to be kept small at an initial stage, and it is necessary to prevent the developer from coming into an engaging portion between a signal detection member (rotational axis of the toner carrying member) and the developing device with the lapse of time.

Figure 11:
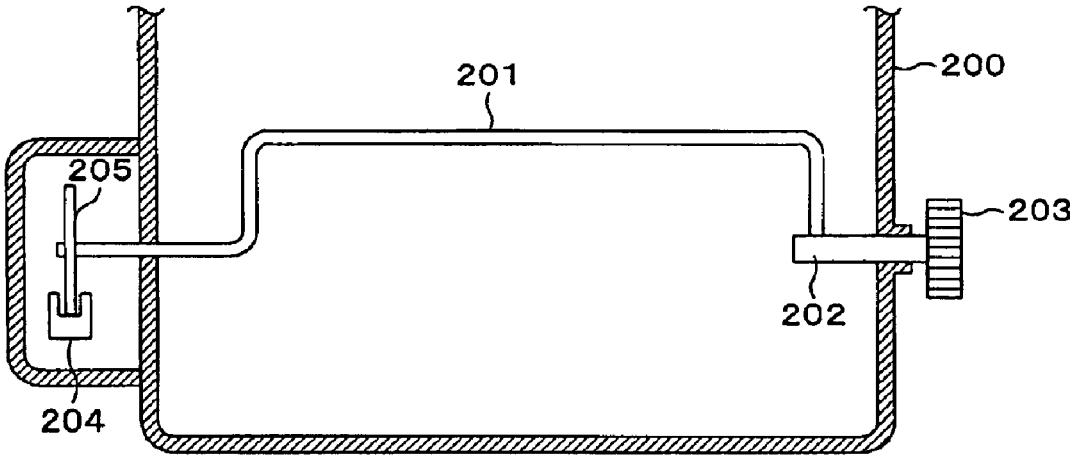
FIG. 11 PRIOR ART
FIG. 11 is an explanatory drawing for showing a conventional toner container.

In an example shown in FIG. 11, there is clearance in a direction of the axis between the developer remaining amount detection member and the developing device, so that the sliding resistance is made small.

Further, a ring-shaped elastic sealing member (shown in FIG. 1) is inserted into the engaging portion between the signal detection member and the developing device, so as to prevent the developer from coming into the engaging portion. However, in this configuration, when an inner portion of the elastic sealing member is made to contact with the signal detection member strongly so as to enhance a sealing force of the elastic sealing member, the rotational resistance with respect to the developer remaining amount detection member is large at an initial state. While, when the inner portion of the elastic sealing member is made to contact with the signal detection member weakly so as to reduce the initial resistance with respect to the developer remaining amount detection member, the developer comes into the engaging portion with the lapse of time, thereby increasing the rotational resistance gradually. That is, the rotational resistance other than the rotational resistance exerted on the developer remaining amount detection member by the developer is hard to be kept sufficiently small at an initial state and with the lapse of time.

Further, it can be said that: the present invention provides a developer remaining amount detection mechanism which enables the rotational resistance other than the rotational resistance exerted on the developer remaining amount detection member by the developer to be kept sufficiently small at an initial state and with the lapse of time. Further, it can be said that: the present invention provides a developer remaining amount detection mechanism such that: it is possible to obtain a stable detection signal even when the developing device is replaced with a new one, and it is possible to make the image forming device smaller.

Further, the detection mechanism shown in FIG. 1 also can be described as follows. That is, the second rotating shaft 90 includes a latching section (an end portion of the second rotating shaft 90 that is positioned in the A direction), the pin 93, and the side blade 95, and the second rotating shaft 90 are latched by the second side plate 88.

The rotating body 84 includes the light shielding plate 98, the opening portion 97, and the contact blade 96, and the rotating body 84 engages with the second rotating shaft 90. The pin 93 and the protruding portion 94 come in contact with each other, so that the second rotating shaft 90 and the toner stirring member 46 integrally rotate. The contact blade 96 and the side blade 95 of the second rotating shaft 90 come into contact with each other, so that the rotating body 84 rotates in synchronism with the second rotating shaft 90, that is, in synchronism with the toner stirring member 46. The opening portion 97 is provided in the rotating body 84, so that it is possible to cover a positional deviation of the second rotating shaft 90 that is caused by the developing unit 44 operating (adjacent to the image holding body).

The light shielding plate 98 is a sector-shaped light shielding plate, and a time during which the light shielding plate 98 passes is monitored by a photosensor 85 using the transmissive photosensor. The photosensor 85 constituted of the transmissive photosensor outputs L (Low) when there is no light shielding object, and the photosensor 85 outputs H (High) when there is a light shielding object.

The photosensor 85 and the light shielding plate 98 are disposed in the present copying machine, and a pulse wave is outputted corresponding to the rotation of the rotating body 84, that is, the rotation of the toner stirring member 46.

FIG. 4 shows phases of the light shielding plate 98 which passes through the photosensor 85. The side blade 95 and the contact blade 96 are positioned so that the light shielding plate 98 provided on the rotating body 84 passes through the photosensor 85 while the toner stirring member 46 moves from the top dead center to the bottom dead center. A continuous line illustrating the light shielding plate 98 corresponds to a position where the toner stirring member 46 is about to fall (top dead center), and a broken line illustrating the light shielding plate 98 corresponds to a position where the toner stirring member 46 has just fallen (bottom dead center).

When there is a sufficient amount of toner in the toner tank 49, the toner stirring member 46 receives the resistance of the toner, so that the light shielding plate 98 rotates at a uniformed rotational speed, so as to output a pulse wave of uniformed interval and uniformed width as shown in FIG. 4(*a*).

When there is little toner in the toner tank 49, the toner stirring member 46 receives little resistance of the toner. The toner stirring member 46 is disproportionately weighted, so that the toner stirring member 46 falls due to gravity after passing the top dead center. The light shielding plate 98 rotates faster during the rotation from the position shown by the continuous line to the position shown by the broken line. As a result, a pulse wave whose H pulse width is shorter than that of FIG. 4(*a*) is outputted as shown in FIG. 4(*b*). By monitoring the pulse widths of FIG. 4(*a*) and FIG. 4(*b*), it is possible to detect little toner remaining in the toner tank 49, thereby learning that it is time to replace the developing device.

By arranging as described above, it is possible to dispose the photosensor 85 and the light shielding plate 98 in the body of the present copying machine. It is possible to obtain a stable detection signal without any change of the positional relationship between the photosensor 85 and the present copying machine even when the toner tank 49 is replaced with a new one. Besides, also when the transmissive photosensor for obtaining a more stable detection signal is used as the photosensor 85, it is possible to insert/pull the toner tank 49 into/from the body of the present copying machine in a rotational direction of the image holding body. Thus, it is possible to make a cross sectional area occupied in inserting/pulling the toner tank 49 smaller, thereby making the present copying machine smaller.

Further, in the present detection mechanism, there is provided the sealing member (elastic sealing member) 81 between the disk-shaped second side plate 88 and an inside wall of the toner tank 49. The sealing member 81 is made of monofoaming material, and is applied to the inside wall of the toner tank 49, and the other side of the sealing member 81 has the high lubricant member 101.

The sealing member 81 is provided so as to be compressed in a direction of axis, and pushes the toner stirring member 46 toward the other end. There is sufficient clearance around an engaging point between the inside portion of the sealing member 81 and the second rotating shaft 90. While, the first side plate 87 and the first rotating shaft 89 that are positioned toward the other end are made of high lubricant material such as polyacetal resin, polyolefine resin, nylon resin, and fluorine resin, and a head of the first rotating shaft 89 (supporting section head) is formed into a hemispherical shape.

By arranging as described, it is possible to make the sliding resistance between the toner stirring member 46 and the sliding member small at an initial state, and it is possible to prevent the developer from coming into the engaging portion between the second rotating shaft 90 and the toner tank 49 so as to make the rotational resistance sufficiently small. Thus, it is possible to maintain a stable detecting performance just before the developer stored in the toner tank 49 runs out.

Further, the present invention also can be described as the following fourth to fourteenth detection mechanisms, and as a first image forming device. That is, the fourth detection mechanism includes a developer remaining amount detection member constituted of a rotating body, disproportionately weighted, that is supported by a developing device, and the developer remaining amount detection member stirs developer stored in a developing device and detects an amount of the remaining developer, wherein an elastic sealing member is provided between (a) an end portion of the developer remaining amount detection member and (b) the inside wall of the developing device so that the end portion faces the external portion of the developing device, so as to push the developer remaining amount detection member against the other end of the developing device.

Further, the fifth detection mechanism is different from the fourth detection mechanism in that: either of the elastic sealing member side face and the end portion of the developer remaining amount detection member has a high lubricant member in a contact point between the elastic sealing member and the end portion of the developer remaining amount detection member. Thus, the rotational resistance initially exerted on the developer remaining amount detection member by the elastic sealing member can be made smaller.

Further, the sixth detection mechanism is different from the fourth or fifth detection mechanism in that: the elastic sealing member is applied to the inside wall of the developing device. Thus, it is possible to prevent the developer from coming from (a) a space between the elastic sealing member and the inside wall of the developing device into (b) the contact point between the signal detection member and the developing device, thereby preventing the rotational resistance from gradually increasing with the lapse of time.

Further, the seventh detection mechanism is arranged similarly to any one of the fourth to sixth detection mechanisms, but is different from them in that: the elastic sealing member is made of monofoaming material. Thus, it is possible to prevent the developer from coming from the elastic sealing member into the contact point between the signal detection member and the developing device, thereby preventing the rotational resistance from gradually increasing with the lapse of time.

Further, the eighth detection mechanism is arranged similarly to any one of the fourth to seventh detection mechanisms, but is different from them in that: the aforementioned other end has a supporting member with a supporting portion, supported in the developing device, whose cross sectional area becomes smaller toward an axis end. Thus, the rotational resistance initially exerted on the developer remaining amount detection mechanism by the supporting portion can be made smaller. Further, the ninth detection mechanism is arranged similarly to any one of the fourth to seventh detection mechanisms, but is different from them in that: the supporting portion supported in the developing device is made of high lubricant material. Thus, it is possible to further reduce the rotational resistance initially exerted on the developer remaining amount detection member by the supporting portion.

Further, the tenth detection mechanism is a developer remaining amount detection mechanism, and includes: a developer remaining amount detection member for (a) stirring the developer in the developing device having a rotating body that is disproportionately weighted and (b) detecting an amount of the remaining developer; and a signal detection member for operating in synchronism with a rotational operation of the developer remaining amount detection member, wherein a latching section is provided so that a latching member latched by the developer remaining amount detection member and the signal detection member can be latched or released in response to an operation for inserting or pulling the developing device to or from the image forming device, and the signal detection member and a signal generating member for generating a detection signal corresponding to an operation of the signal detection member are provided in a body of the image forming device. Thus, it is possible to obtain a stable output signal so as not to be influenced by individual differences in terms of a position where the developing device is installed in the image forming device.

Further, the eleventh detection mechanism is different from the tenth detection mechanism in that: the latching section can be installed/detached in the rotational axis direction of the developer remaining amount detection member. Thus, the direction in which the developing device is installed/detached with respect to the image forming device can be set to the rotational axis direction of the image holding body, so that it is possible to reduce the cross sectional area occupied in installing/detaching the developing device, thereby reducing the size of the image forming device.

Further, the twelfth detection mechanism is different from the tenth or eleventh detection mechanism is that: the latching section is disposed in a predetermined position where the developing device is installed in the image forming section so that the protruding portion of the latching member latches the protruding portion of the signal detection member in the rotational direction of the developer remaining amount detection member. Thus, a positional relationship between the developer remaining amount detection member and the signal detection member can be kept in a predetermined positional relationship no matter where the developing device may be installed in the image forming device.

Further, the thirteenth detection mechanism is different from the twelfth detection mechanism in that: the protruding portion is positioned so that the signal detection section of the signal detection member passes through the signal generating section while the developer remaining amount detection member moves from the top dead center to the bottom dead center, thereby steadily detecting that little developer remains in the developing device.

Further, the fourteenth detection mechanism is arranged similarly to any one of the tenth to thirteenth detection mechanism, but is different from them in that: either of the latching member and the signal detection member has a cone-shaped latch opening portion. Thus, it is possible to cover the positional deviation of the developer remaining amount detection member that is caused by the image holding body adjacently operating in the developing device upon installing/detaching the developing device with respect to the image forming device, so that the developer remaining amount detection member and the signal detection member can engage with each other without fail.

Further, the first image forming device includes any one of the fourth to fourteenth detection mechanisms.

The invention being thus described, it will be obvious that the same may be varied in many ways. Such variations are not to be regarded as a departure from the spirit and scope of the invention, and all such modifications as would be obvious to one skilled in the art intended to be included within the scope of the of the following claims.

What is claimed is:

1. A remaining amount detection mechanism, comprising:

a rotating shaft that is inserted into a through hole provided in a developer tank of a developing unit used in a printer;

a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein:

a flange face is provided on an internal portion of the rotating shaft so as to be positioned inside the developer tank, and a sealing member made of elastic material is disposed between (a) a pierced wall surface of the developer tank through which the through hole is provided and (b) the flange face of the rotating shaft, so as to surround the rotating shaft, and the sealing member closely contacts both the pierced wall surface and the flange face.

2. The remaining amount detection mechanism as set forth in claim 1, wherein the sealing member is bonded to one of the pierced wall surface and the flange face, and a high lubricant member is provided on a surface of the sealing member which surface is in contact with the other of the pierced wall surface and the flange face.

3. The remaining amount detection mechanism as set forth in claim 2, wherein the high lubricant member is such that a coefficient of dynamic friction is not more than 0.3.

4. The remaining amount detection mechanism as set forth in claim 2, wherein the sealing member is bonded to the pierced wall surface.

5. The remaining amount detection mechanism as set forth in claim 1, wherein the sealing member is made of monofoaming material.

6. The remaining amount detection mechanism as set forth in claim 1, wherein:

one end portion of the rotating shaft inside the developer tank is supported by an abutting roller bearing provided on a wall opposite to the pierced wall surface in the developer tank, and a head of the end portion is smaller than a middle portion of the rotating shaft in terms of a cross sectional area.

7. The remaining amount detection mechanism as set forth in claim 6, wherein the end portion is made of high lubricant material.

8. The remaining amount detection mechanism as set forth in claim 7, wherein the high lubricant material functioning as the end portion is such that a coefficient of dynamic friction is not more than 0.3.

9. The remaining amount detection mechanism as set forth in claim 6, wherein the end portion is formed in a hemispherical shape.

10. The remaining amount detection mechanism as set forth in claim 1, wherein:

the rotating shaft and the stirring member are provided in a developing unit, including the developer tank, that is detachable from a body of the printer, and the sensor section is provided in the body of the printer, and the sensor section includes (a) a light shielding plate for rotating with the rotating shaft and (b) a transmissive photosensor provided so as to sandwich a rotational orbit of the light shielding plate.

11. The remaining amount detection mechanism as set forth in claim 10, wherein the developing unit is installed along the rotating shaft into the printer so that the pierced wall surface of the developer tank through which the rotating shaft is inserted is disposed on a back side of the printer.

12. The remaining amount detection mechanism as set forth in claim 11, wherein the developing unit includes a driving member for transmitting a rotational force to the rotating shaft, and the driving member is in contact with an external portion of the rotating shaft so as to be positioned outside the developer tank.

13. The remaining amount detection mechanism as set forth in claim 1, wherein:

the rotating shaft and the stirring member are provided in a developing unit, including the developer tank, that is detachable from a body of the printer, and the sensor section is provided in the body of the printer, and the sensor section includes (i) a light reflecting plate for rotating with the rotating shaft and (ii) a reflective photosensor, and the reflective photosensor has (a) a light emitting portion and (b) a light receiving portion for receiving light reflected by the light reflecting plate after being emitted from the light emitting portion.

14. The remaining amount detection mechanism as set forth in claim 1, wherein:

the rotating shaft and the stirring member are provided in a developing unit, including the developer tank, that is detachable from a body of the printer, and the sensor section is provided in the body of the printer, and the rotating shaft has a side blade, which extends along a rotating central axis, on a side face thereof, and the sensor section has (i) a rotating body for rotating around the rotating central axis of the rotating shaft and (ii) a transmissive photosensor, and the rotating body has (a) a contact blade which contacts the side blade of the rotating shaft from a direction along a rotational direction and (b) a light shielding plate for passing through the transmissive photosensor of the sensor section.

15. The remaining amount detection mechanism as set forth in claim 14, wherein the rotating body has a balancer for shifting the rotating body's center of gravity to the rotating central axis.

16. The remaining amount detection mechanism as set forth in claim 14, wherein the developing unit is installed along the rotating shaft into the printer so that the pierced wall surface of the developer tank through which the rotating shaft is inserted is disposed on a back side of the printer.

17. The remaining amount detection mechanism as set forth in claim 16, wherein the rotating body has an opening portion into which the rotating shaft is inserted, and the contact blade is provided on an inside wall of the opening portion.

18. The remaining amount detection mechanism as set forth in claim 17, wherein an opening end of the opening portion is expanded.

19. The remaining amount detection mechanism as set forth in claim 16, wherein the developing unit includes a driving member for transmitting a rotational force to the rotating shaft, and the driving member is in contact with an external portion of the rotating shaft so as to be positioned outside the developer tank.

20. A remaining amount detection mechanism, comprising:

a rotating shaft that is inserted into a through hole provided in a developer tank of a developing unit used in a printer;

a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein:

the rotating shaft and the stirring member are provided in a developing unit, including the developer tank, that is detachable from a body of the printer, and the sensor section is provided in the body of the printer, and the rotating shaft has a side blade, which extends along a rotating central axis, on a side face thereof, and the sensor section has (i) a rotating body for rotating around the rotating central axis of the rotating shaft and (ii) a transmissive photosensor, and the rotating body has (a) a contact blade which contacts the side blade of the rotating shaft from a direction along a rotational direction and (b) a light shielding plate for passing through the transmissive photosensor of the sensor section.

21. The remaining amount detection mechanism as set forth in claim 20, wherein the rotating body has a balancer for shifting the rotating body's center of gravity to the rotating central axis.

22. The remaining amount detection mechanism as set forth in claim 20, wherein the developing unit is installed along the rotating shaft into the printer so that a pierced wall surface of the developer tank through which the rotating shaft is inserted is disposed on a back side of the printer.

23. The remaining amount detection mechanism as set forth in claim 22, wherein the rotating body has an opening portion into which the rotating shaft is inserted, and the contact blade is provided on an inside wall of the opening portion.

24. The remaining amount detection mechanism as set forth in claim 23, wherein an opening end of the opening portion is expanded.

25. The remaining amount detection mechanism as set forth in claim 22, wherein the developing unit includes a driving member for transmitting a rotational force to the rotating shaft, and the driving member is in contact with an external portion of the rotating shaft so as to be positioned outside the developer tank.

26. A remaining amount detection mechanism, comprising:

a rotating shaft that is inserted into a through hole provided in a developer tank of a developing unit used in a printer;

a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein:

the rotating shaft and the stirring member are provided in a developing unit, including the developer tank, that is detachable from a body of the printer, and the developing unit includes a driving member for transmitting a rotational force to the rotating shaft, and the driving member is in contact with an external portion of the rotating shaft so as to be positioned outside the developer tank, and the developing unit is installed along the rotating shaft into the printer so that a pierced wall surface of the developer tank through which the rotating shaft is inserted is disposed on a back side of the printer.

27. A printer comprising:

a remaining amount detection mechanism for developer that includes:

a rotating shaft that is inserted into a through hole provided in a developer tank of a developing unit used in a printer;

a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein:

a flange face is provided on an internal portion of the rotating shaft so as to be positioned inside the developer tank, and a sealing member made of elastic material is disposed between (a) a pierced wall surface of the developer tank through which the through hole is provided and (b) the flange face of the rotating shaft, so as to surround the rotating shaft, and the sealing member closely contacts both the pierced wall surface and the flange face.

28. A printer comprising:

a remaining amount detection mechanism for developer that includes, a rotating shaft that is inserted into a through hole provided in a developer tank of a developing unit used in a printer;

a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein:

the rotating shaft and the stirring member are provided in a developing unit, including the developer tank, that is detachable from a body of the printer, and the sensor section is provided in the body of the printer, and the rotating shaft has a side blade, which extends along a rotating central axis, on a side face thereof, and the sensor section has (i) a rotating body for rotating around the rotating central axis of the rotating shaft and (ii) a transmissive photosensor, and the rotating body has (a) a contact blade which contacts the side blade of the rotating shaft from a direction along a rotational direction and (b) a light shielding plate for passing through the transmissive photosensor of the sensor section.

29. A printer comprising:

a remaining amount detection mechanism for developer that includes;

a rotating shaft that is inserted into a through hole provided in a developer tank of a developing unit used in a printer;

a stirring member, provided on the rotating shaft, that rotates in the developer tank in combination with the rotating shaft while receiving resistance exerted by developer stored in the developer tank; and a sensor section that detects an amount of the developer remaining in the developer tank in accordance with a rotational condition of the rotating shaft, wherein:

the rotating shaft and the stirring member are provided in a developing unit, including the developer tank, that is detachable from a body of the printer, and the developing unit includes a driving member for transmitting a rotational force to the rotating shaft, and the driving member is in contact with an external portion of the rotating shaft so as to be positioned outside the developer tank, and the developing unit is installed alone the rotating shaft into the printer so that a pierced wall surface of the developer tank through which the rotating shaft is inserted is disposed on a back side of the printer.

* * * * *